US009703241B2

(12) United States Patent
Hazeyama et al.

(10) Patent No.: US 9,703,241 B2
(45) Date of Patent: Jul. 11, 2017

(54) FIXING DEVICE PROVIDED WITH NIP MEMBER CAPABLE OF PREVENTING OUTFLOW OF LUBRICANT

(71) Applicant: Brother Kogyo Kabushiki Kaisha, Nagoya-shi, Aichi-ken (JP)

(72) Inventors: Tomoaki Hazeyama, Yokkaichi (JP); Yasuhiro Maruyama, Kasugai (JP); Akihiro Kobayashi, Inazawa (JP); Naoyuki Iwata, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/502,387

(22) Filed: Sep. 30, 2014

(65) Prior Publication Data

US 2015/0093167 A1 Apr. 2, 2015

(30) Foreign Application Priority Data

Sep. 30, 2013 (JP) ..... 2013-203249
Sep. 30, 2013 (JP) ..... 2013-203766

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
USPC ..... 399/329
See application file for complete search history.

(56) References Cited

U.S. PATENT DOCUMENTS

| | | | | |
|---|---|---|---|---|
| 6,456,819 | B1 | 9/2002 | Abe et al. | |
| 7,805,102 | B2 | 9/2010 | Kato | |
| 8,509,667 | B2 | 8/2013 | Miyauchi | |
| 2008/0187372 | A1 | 8/2008 | Kato | |
| 2011/0158716 | A1* | 6/2011 | Fujiwara | G03G 15/2053 399/329 |

(Continued)

FOREIGN PATENT DOCUMENTS

| | | | |
|---|---|---|---|
| JP | H09-101695 | A | 4/1997 |
| JP | H10-198200 | A | 7/1998 |

(Continued)

OTHER PUBLICATIONS

May 9, 2017—(JP) Office Action—App 2013-203249—Eng Tran.

*Primary Examiner* — Minh Phan
(74) *Attorney, Agent, or Firm* — Banner & Witcoff, Ltd.

(57) ABSTRACT

A fixing device includes: an endless fusing belt; a heater; a nip member; and a backup member. The endless fusing belt has a width in a widthwise direction. The nip member is disposed spaced apart from the heater. The nip member has a contact surface. The contact surface has widthwise end portions in the widthwise direction. The backup member is configured to nip the fusing belt in cooperation with the nip member. The fusing belt is configured to move in a moving direction at a position where the fusing belt is nipped between the nip member and the backup member. The contact surface has at least two grooves one formed in corresponding one of the widthwise end portions and another formed in the other of the widthwise end portions and extending at an angle equal to or smaller than 10 degrees with respect to the moving direction.

14 Claims, 16 Drawing Sheets

(56) References Cited

U.S. PATENT DOCUMENTS

| | | | | |
|---|---|---|---|---|
| 2012/0051809 | A1 | 3/2012 | Miyauchi | |
| 2012/0163848 | A1 | 6/2012 | Okano et al. | |
| 2012/0275830 | A1 | 11/2012 | Suzuki et al. | |
| 2012/0275831 | A1* | 11/2012 | Ishida | G03G 15/2025 399/329 |
| 2013/0170877 | A1* | 7/2013 | Yoshiura | G03G 15/2085 399/323 |
| 2014/0369726 | A1* | 12/2014 | Soeda | G03G 15/2053 399/329 |

FOREIGN PATENT DOCUMENTS

| | | | |
|---|---|---|---|
| JP | 2001-042670 | A | 2/2001 |
| JP | 2003-140492 | A | 5/2003 |
| JP | 2008-146964 | A | 6/2008 |
| JP | 2010-096940 | A | 4/2010 |
| JP | 2012-053105 | A | 3/2012 |
| JP | 2012-141349 | A | 7/2012 |
| JP | 2012-233969 | A | 11/2012 |

* cited by examiner

TOP
LEFT
RIGHT
BOTTOM
100
110
112
120
120B
120A
120B
121
122
130
111
131
151
150
152

DISTRI-
BUTION
TH1
(TH2)

131B(131D)
132
131A(131C)
132
131B(131D)
132
130
131
L1(L2)
L1(L2)
L1(L2)
FRONT
LEFT
RIGHT
REAR

FIXING DEVICE PROVIDED WITH NIP MEMBER CAPABLE OF PREVENTING OUTFLOW OF LUBRICANT

CROSS REFERENCE TO RELATED APPLICATION

This application claims priority from Japanese Patent Application Nos. 2013-203249 filed Sep. 30, 2013 and 2013-203766 filed Sep. 30, 2013. The entire content of each of the priority applications is incorporated herein by reference.

TECHNICAL FIELD

The present invention relates to a fixing device for thermally fixing a developer image onto a recording sheet.

The present invention also relates to a fixing device used in an electrophotographic-type image forming apparatus, and an image forming apparatus provided with the fixing device.

BACKGROUND

As a fixing device for thermally fixing a developer image onto a recording sheet such as a sheet of paper, there is conventionally known one that includes an endless fusing belt, a nip member disposed in an internal space of the fusing belt, and a backup member such as a pressure roller that nips the fusing belt in cooperation with the nip member. In the fixing device having such a configuration (hereinafter referred to as first conventional fixing device), lubricant is provided between the fusing belt and the nip member in order to enhance slidability between the nip member and the circularly moving fusing belt.

Further, typically, an electrophotographic-type image forming apparatus includes an image carrier, a transfer member, and a fixing device. The image carrier is capable of carrying thereon an image formed by a developer such as toner. The transfer member transfers the developer image carried on the image carrier onto a recording sheet. The fixing device thermally fixes the transferred developer image onto the recording sheet. As such a fixing device, there is known a fixing device of a type (hereinafter referred to as a second conventional fixing device) in which an endless belt (fusing film) is nipped between a nip member disposed at a side of an inner peripheral surface of the endless belt and a rotatable body (pressure roller) disposed at a side of an outer peripheral surface of the endless belt. In the second conventional fixing device, while a recording sheet carrying a developer image is nipped and conveyed between the belt and the rotatable body, the developer is heated and melted to be fixed on the recording sheet.

There is known a configuration adopted by the second conventional fixing device, in which a flow guide groove is formed on a contact surface of the nip member that is brought into sliding contact with the belt in order to uniformly disperse lubricant used for enhancing slidability between the nip member and the belt.

SUMMARY

In the first conventional fixing device, the fusing belt is nipped between the nip member and the backup member, and thus, a constant pressing force is applied to the lubricant between the nip member and the fusing belt to move the lubricant toward edges of the fusing belt. This may cause the lubricant to leak from the edges of the fusing belt.

In view of the foregoing, it is an object of the present invention to provide a fixing device capable of preventing lubricant from leaking from edges of a fusing belt.

In the second conventional fixing device, the above-described configuration allows uniform dispersion of the lubricant on the contact surface of the nip member. However, this configuration does not take into account the lubricant flowing outside the contact surface. When flowing out of the contact surface, the lubricant may leak into a back side of the nip member through a smooth surface of the nip member to contaminate components provided inside the fixing device. Reduction of the lubricant due to such outflow may deteriorate the slidability of the belt, which in turn may increase possibilities of an increase in driving torque of the belt or slippage of the belt and may accelerate degradation of the fixing device.

In view of the foregoing, it is another object of the present invention to provide a fixing device capable of preventing lubricant from flowing outside in a sheet conveying direction from a contact surface of the nip member.

In order to attain the above and other objects, the present invention provides a fixing device that may include: an endless fusing belt; a heater; a nip member; and a backup member. The fusing belt may have a width in a widthwise direction. The nip member may be disposed spaced apart from the heater. The nip member may have a contact surface. The contact surface may have widthwise end portions in the widthwise direction. The backup member may be configured to nip the fusing belt in cooperation with the nip member. The fusing belt may be configured to move in a moving direction at a position where the fusing belt is nipped between the nip member and the backup member. The contact surface may have at least two grooves one formed in corresponding one of the widthwise end portions and another formed in the other of the widthwise end portions and extending at an angle equal to or smaller than 10 degrees with respect to the moving direction.

According to another aspect, the present invention provides a fixing device that may include: an endless fusing belt; a nip member; and a backup member. The fusing belt may have an inner surface and an outer surface, and define an internal space. The nip member may extend through the internal space and have a surface facing the inner surface. The backup member may be configured to nip the fusing belt in cooperation with the nip member and to convey a recording sheet in a sheet conveying direction with the recording sheet nipped between the backup member and the fusing belt. The surface of the nip member may include an upstream region, a center region, and a downstream region arrayed in this order in the sheet conveying direction. The center region may be configured to contact the fusing belt through a lubricant. The upstream region and the downstream region may be spaced apart from the fusing belt. At least one of the upstream region and the downstream region may have a retaining portion configured to provide a lubricant retaining force greater than that of the center region.

According to still another aspect, the present invention provides an image forming apparatus that may include: a frame; an image carrier; a transfer member; and a fixing device. The image carrier may be configured to carry a developer image thereon. The transfer member may be configured to transfer the developer image onto a recording sheet. The fixing device may be fixed to the frame. The fixing device may include: an endless fusing belt; a nip member e; and a backup member. The fusing belt may have an inner surface and an outer surface, and define an internal space. The nip member may extend through the internal space, and have a surface facing the inner surface. The backup member may be configured to nip the fusing belt in cooperation with the nip member and to convey a recording sheet in a sheet conveying direction with the recording sheet nipped between the backup member and the fusing belt. The surface of the nip member including an upstream region, a center region, and a downstream region arrayed in this order in the sheet conveying direction. The center region may be configured to contact the fusing belt through a lubricant. The upstream region and the downstream region may be spaced apart from the fusing belt. At least one of the upstream region and the downstream region may have a retaining portion configured to provide a lubricant retaining force greater than that of the center region.

BRIEF DESCRIPTION OF THE DRAWINGS

In the drawings;

FIGS. 12A through 12D are views of a nip plate provided in the fixing device, in which FIG. 12A is a perspective view, FIG. 12B is a cross-sectional view, FIG. 12C is an enlarged cross-sectional view of a downstream end portion; and FIG. 12D is an enlarged cross-sectional view of an upstream end portion;

FIGS. 14A through 14D are views of a nip plate according to one variation of the fourth embodiment, in which FIG. 14A is a perspective view, FIG. 14B is a cross-sectional view, FIG. 14C is an enlarged cross-sectional view of a downstream end portion, and FIG. 14D is an enlarged cross-sectional view of an upstream end portion;

DETAILED DESCRIPTION

1. First Embodiment

General Structure of Laser Printer

Figure 1:
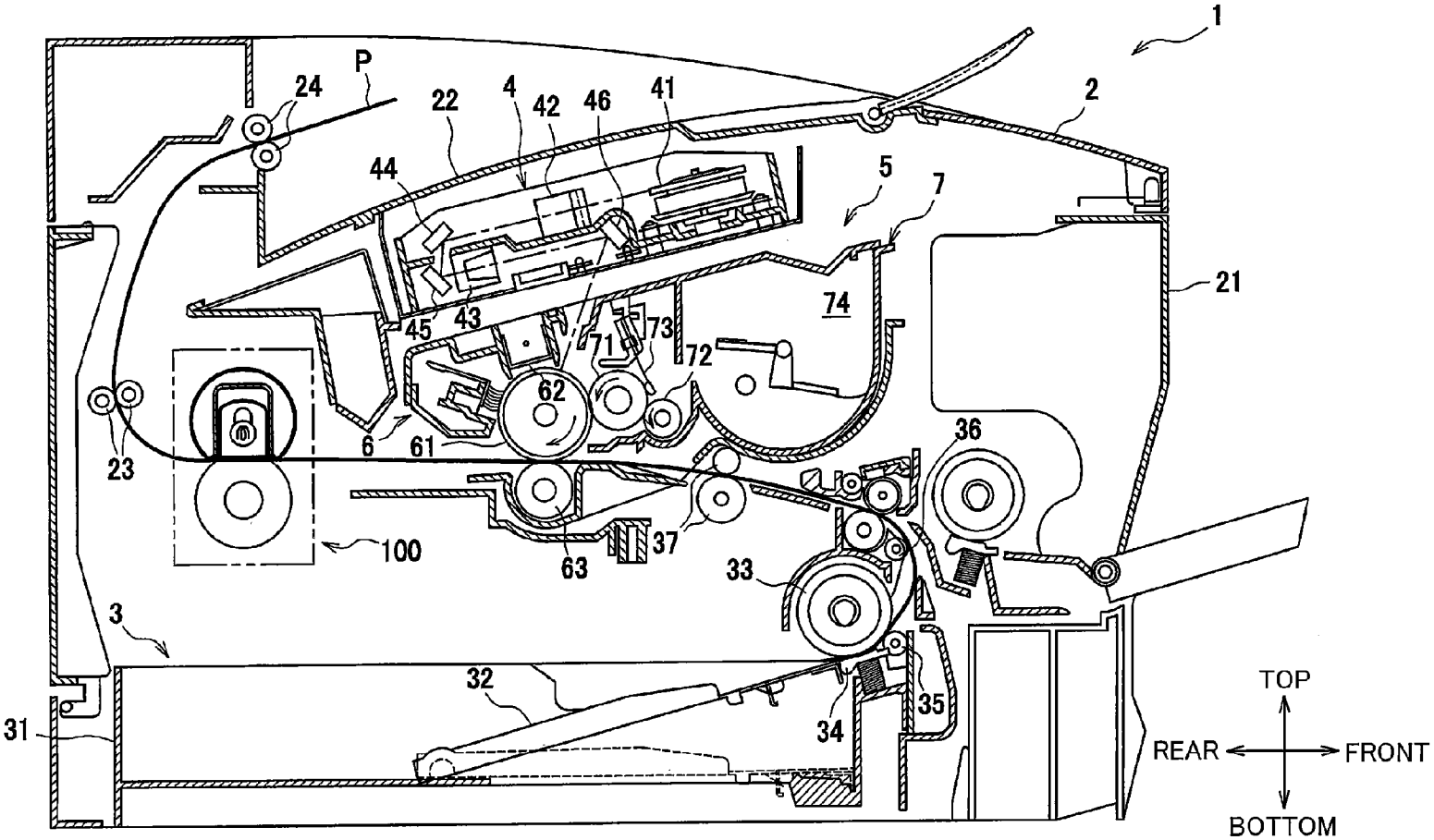
FIG. 1 is a cross-sectional view of a laser printer provided with a fixing device according to a first embodiment of the present invention.

Next, a general structure of a laser printer 1 as an image forming apparatus provided with a fixing device 100 according to a first embodiment of the present invention will be described with reference to FIG. 1. A detailed structure of the fixing device 100 according to the first embodiment will be described later while referring to FIGS. 2 through 6D, wherein like parts and components are designated by the same reference numerals to avoid duplicating description.

In the following description (first to third embodiments and modifications thereof), the terms "upward", "downward", "upper", "lower", "above", "below", "beneath", "right", "left", "front", "rear" and the like will be used assuming that the laser printer 1 is disposed in an orientation in which it is intended to be used. More specifically, a left side and a right side in FIG. 1 are a rear side and a front side, respectively. Further, a far side and a near side in FIG. 1 are a right side and a left side, respectively. That is, the left and right sides of the laser printer 1 will be based on the perspective of a user facing the front side of the laser printer 1. Further, a top side and a bottom side in FIG. 1 are a top side and a bottom side, respectively.

As illustrated in FIG. 1, the laser printer 1 includes a main casing 2 having a front cover 21. The front cover 21 covers an opening formed in the main casing 2 at its closed position and exposes the opening at its open position. The laser printer 1 further includes, within the main casing 2, a sheet supply unit 3 for supplying a sheet P as an example of a recording sheet, an exposure device 4, a process cartridge 5 for transferring a toner image onto the sheet P, and the fixing device 100 for thermally fixing the toner image on the sheet P.

The sheet supply unit 3 is provided inside the main casing 2 at a bottom portion thereof. The sheet supply unit 3 includes a sheet supply tray 31 for accommodating the sheets P, a lifter plate 32 for lifting up front edges of the sheets P, a sheet supply roller 33, a sheet supply pad 34, paper dust removing rollers 35, 36, and a pair of registration rollers 37. The sheets P accommodated in the sheet supply tray 31 are directed toward the sheet supply roller 33 by the lifter plate 32 and are separated one by one by the sheet supply roller 33 and the sheet supply pad 34. Each separated sheet P is conveyed toward the process cartridge 5, passing through the paper dust removing rollers 35, 36, and the registration rollers 37.

The exposure device 4 is disposed inside the main casing 2 at a top portion thereof. The exposure device 4 includes a laser emission unit (not illustrated), a rotatably driven polygon mirror 41, lenses 42, 43, and reflection mirrors 44, 45, 46. In the exposure device 4, a laser beam (indicated by a dashed line in FIG. 1) based on image data emitted from the laser emission unit scans a surface of a photosensitive drum 61 (described later) at a high speed, after passing through or reflected by the polygon mirror 41, the lens 42, the reflection mirrors 44, 45, the lens 43, and the reflection mirror 46 in this order.

The process cartridge 5 is disposed below the exposure device 4. The process cartridge 5 is configured to be detachably attached to the main casing 2 through the opening formed in the main casing 2. The process cartridge 5 includes a drum unit 6 and a developing unit 7.

The drum unit 6 includes the photosensitive drum 61, a charger 62, and a transfer roller 63. The developing unit 7 is configured to be detachably attached to the drum unit 6. The developing unit 7 includes a developing roller 71, a supply roller 72, a layer thickness regulating blade 73, and a toner chamber 74 for accommodating toner (developer) therein.

In the process cartridge 5, the surface of the photosensitive drum 61 is exposed by the high-speed scanning of the laser beam emitted from the exposure device 4, after the charger 62 applies a uniform charge to the surface of the photosensitive drum 61, whereby an electrostatic latent image based on image data is formed on the photosensitive drum 61. At this time, the toner accommodated in the toner chamber 74 is supplied to the developing roller 71 through the supply roller 72 and enters between the developing roller 71 and the layer thickness regulating blade 73 to be carried on the developing roller 71 as a thin layer having a uniform thickness.

The toner carried on the developing roller 71 is supplied to the electrostatic latent image formed on the photosensitive drum 61 as the developing roller 71 rotates. As a result, a visible toner image corresponding to the electrostatic latent image is formed on the photosensitive drum 61. Subsequently, the sheet P is conveyed between the photosensitive drum 61 and the transfer roller 63, causing the toner image on the photosensitive drum 61 to be transferred onto the sheet P.

The fixing device 100 is disposed rearward of the process cartridge 5. While the sheet P onto which the toner image has been transferred passes through the fixing device 100, the toner image is thermally fixed onto the sheet P. Then, the resultant sheet P is discharged on a discharge tray 22 by conveyor rollers 23 and 24.

Detailed Structure of Fixing Device

Figure 2:
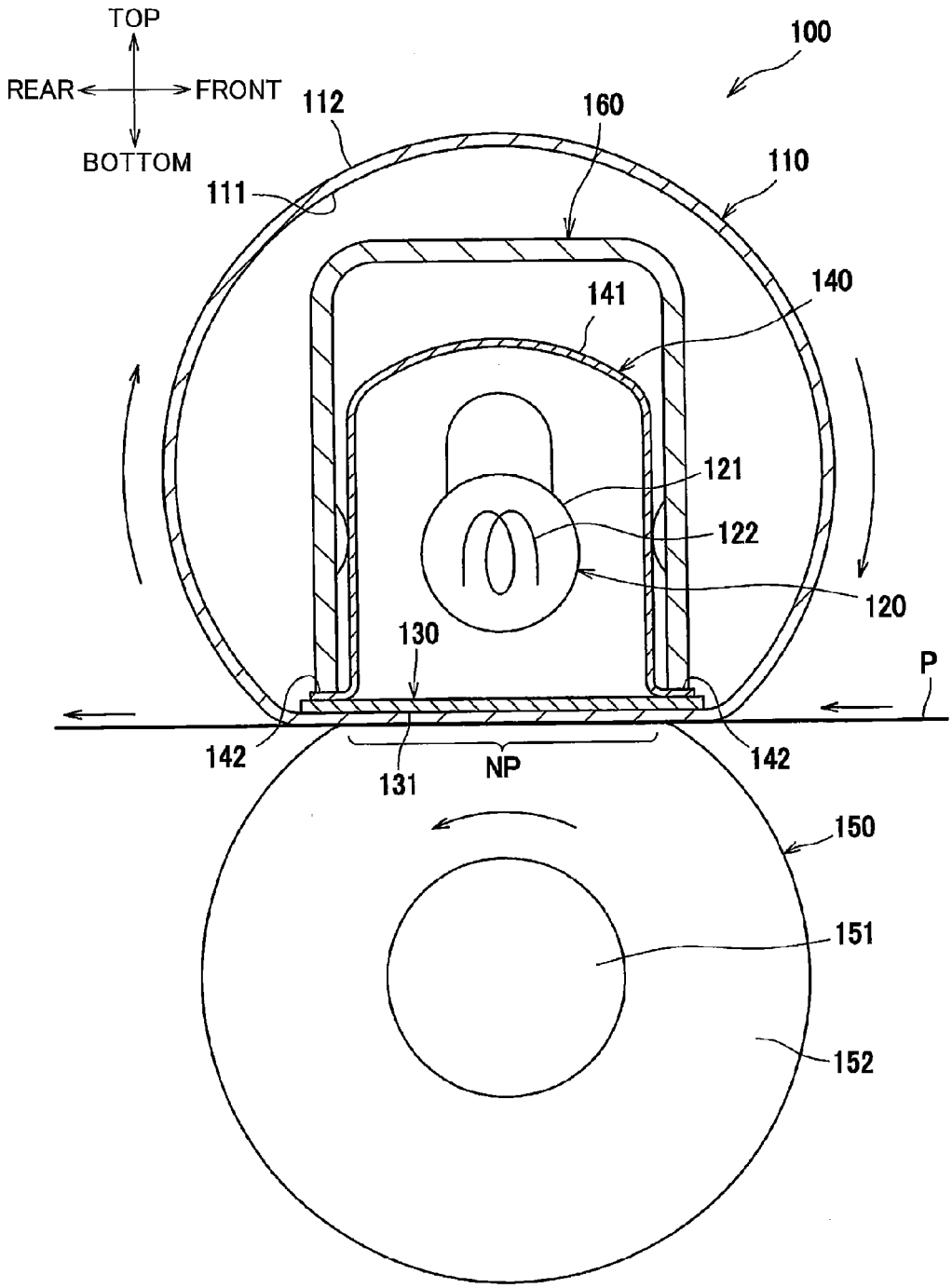
FIG. 2 is a cross-sectional view of the fixing device according to the first embodiment taken along a plane perpendicular to a left-right direction.

As illustrated in FIG. 2, the fixing device 100 includes a fusing belt 110, a halogen lamp 120 as an example of a heater, a nip plate 130 as an example of a nip member, a reflection member 140, a pressure roller 150 as an example of a backup member, and a stay 160.

The fusing belt 110 is an endless belt having heat resistance and flexibility. The fusing belt 110 includes an element tube formed of metal such as stainless steel and a coating layer, such as fluorine resin, formed over a surface of the element tube.

The fusing belt 110 is circularly movable in a clockwise direction in FIG. 2. More specifically, the fusing belt 110 moves from front to rear between the nip plate 130 and the pressure roller 150 while being guided by a guide member (not illustrated). When the fusing belt 110 circularly moves, an inner peripheral surface 111 thereof is brought into sliding contact with the nip plate 130, and an outer peripheral surface 112 thereof contacts the pressure roller 150 (or the sheet P).

A moving direction of the fusing belt 110 at a position between the nip plate 130 (contact surface 131) and the pressure roller 150 is the same as a sheet conveying direction of the sheet P conveyed through the fixing device 100, which is defined as a direction along a front-rear direction in the present embodiment.

The halogen lamp 120 is a heater that heats the nip plate 130 and the fusing belt 110 to thereby heat the toner that has been transferred onto the sheet P. The halogen lamp 120 is disposed in an internal space defined by the inner peripheral surface 111 of the fusing belt 110 and spaced apart, by a predetermined interval, from the inner peripheral surface 111 of the fusing belt 110.

The halogen lamp 120 includes a glass tube 121 elongated in a left-right direction and a helically wound filament 122 disposed in the glass tube 121. The halogen lamp 120 is configured to generate heat in the internal space of the fusing belt 110 by electric power supply to the filament 122.

The nip plate 130 is a plate-like member that receives a radiant heat from the halogen lamp 120. The nip plate 130 is disposed in the internal space of the fusing belt 110 so as to be spaced apart, by a predetermined interval, from the halogen lamp 120 and to be brought into sliding contact with the inner peripheral surface 111 of the fusing belt 110. The nip plate 130 of the present embodiment is formed into a substantially flat plate-like shape that is elongated in the left-right direction.

The nip plate 130 is adapted to transmit the radiant heat received from the halogen lamp 120 to the toner on the sheet P through the fusing belt 110 and is, to this effect, formed of a metallic plate such as an aluminum plate having a heat conductivity higher than that of the stay 160 (described later) made of steel. The nip plate 130 may have, over a surface thereof, a metal oxide film or a fluorine resin layer. A detailed configuration of the nip plate 130 will be described later.

The reflection member 140 is a member that reflects the radiant heat from the halogen lamp 120 toward the nip plate 130. The reflection member 140 is disposed in the internal space of the fusing belt 110 so as to be spaced apart, by a predetermined interval, from the halogen lamp 120 and to surround the halogen lamp 120.

The reflection member 140 is formed by bending an aluminum plate having a high reflection ratio regarding an infrared ray and a far-infrared ray. More specifically, the reflection member 140 has a reflecting portion 141 having a substantially U-shaped cross-section, and flange portions 142 respectively extending outward in the front-rear direction from both end portions of the reflecting portion 141. In order to enhance the heat reflection ratio of the reflection member 140, the reflection member 140 may be formed of an aluminum plate to which mirror surface finishing is applied.

The pressure roller 150 is a roller that conveys the sheet P in cooperation with the nip plate 130 through the fusing belt 110. The pressure roller 150 is disposed below the nip plate 130 so as to nip the fusing belt 110 in cooperation with the nip plate 130. The pressure roller 150 includes a metallic shaft 151 and an elastically deformable roller body 152 provided on an outer periphery of the shaft 151.

The pressure roller 150 nips the fusing belt 110 in cooperation with the nip plate 130 in a state where a part of the roller body 152 is elastically deformed to thereby provide a nip NP between the pressure roller 150 and the fusing belt 110. The pressure roller 150 and the nip plate 130 are disposed such that one of the pressure roller 150 and the nip plate 130 is pressed against the other of the pressure roller 150 and the nip plate 130.

The pressure roller 150 is driven to rotate upon transmission of a drive force from a motor (not illustrated) provided inside the main casing 2. As the pressure roller 150 rotates, the fusing belt 110 is circularly moved by a frictional force generated between the pressure roller 150 and the fusing belt 110 (or between the sheet P and the fusing belt 110). The sheet P on which a toner image has been transferred is conveyed between the pressure roller 150 and the heated fusing belt 110, whereby the toner image is thermally fixed onto the sheet P.

The stay 160 is a member that supports the nip plate 130 through the flange portions 142 of the reflection member 140 to thereby ensure rigidity of the nip plate 130 to which a load from the pressure roller 150 is applied. The stay 160 is disposed in the internal space of the fusing belt 110 so as to surround the reflection member 140. The stay 160 has a substantially U-shape in cross-section in conformity with an outer shape of the reflection member 140 (reflecting portion 141). The stay 160 is formed by bending a steel plate or any other plate having relatively high rigidity.

Detailed Structure of Nip Plate

Figure 3A:
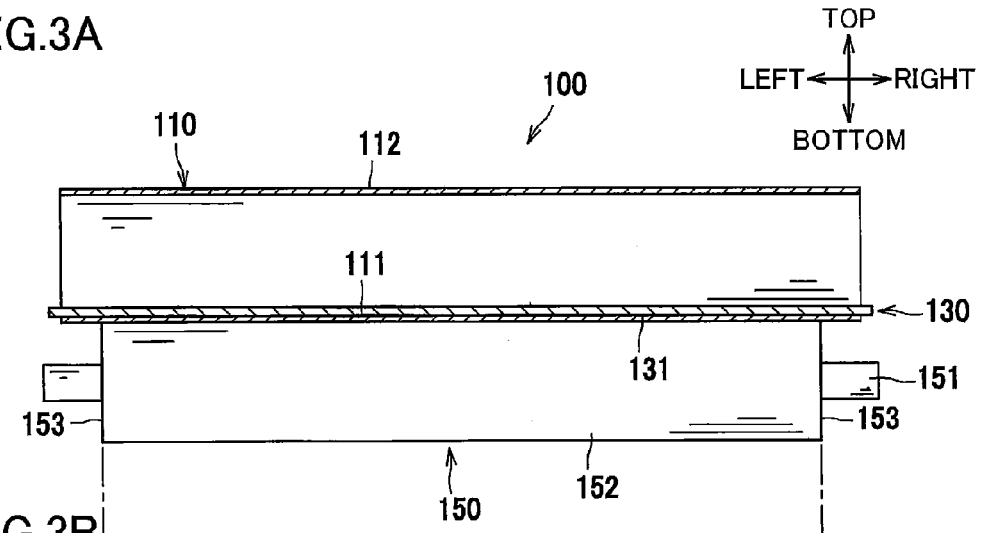
FIG. 3A is a cross-sectional view of the fixing device taken along a plane perpendicular to a front-rear direction.
Figure 3B:
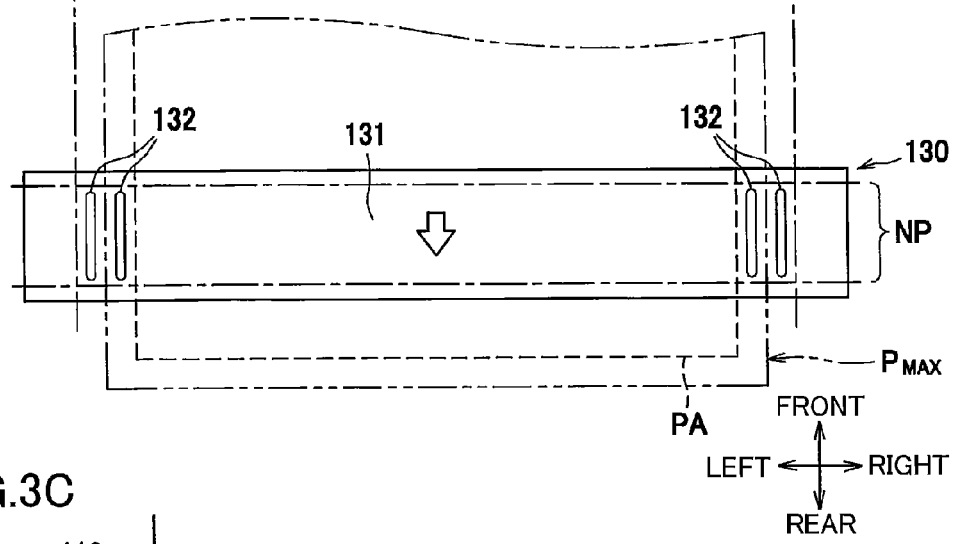
FIG. 3B is a bottom plan view of a nip plate of the fixing device, showing a contact surface of the nip plate.
Figure 3C:
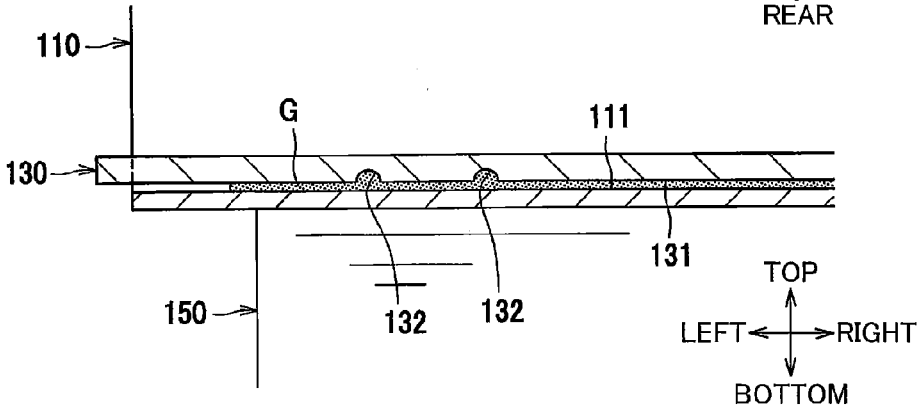
FIG. 3C is a partial enlarged cross-sectional view of a left end portion of the fixing device.

As illustrated in FIGS. 3A through 3C, the nip plate 130 has a contact surface 131 that can be brought into sliding contact with the inner peripheral surface 111 of the circularly moving fusing belt 110. A grease G as an example of a lubricant is provided between the contact surface 131 of the nip plate 130 and the inner peripheral surface 111 of the fusing belt 110. The grease G is used for enhancing slidability between the contact surface 131 and the inner peripheral surface 111. That is, the contact surface 131 can be brought into sliding contact with the inner peripheral surface 111 through the grease G.

The contact surface 131 has a plurality of grooves 132 at both end portions thereof in a widthwise direction of the fusing belt 110 (hereinafter, also referred to as left-right direction).

Each groove 132 is recessed upward from the contact surface 131. More specifically, each groove 132 has a shape recessed toward an upper side (a side at which the halogen lamp 120 is disposed) from a lower side (a side at which the pressure roller 150 is disposed). Each groove 132 is elongated and extends along a moving direction of the fusing belt 110 (hereinafter, also referred to merely as "moving direction") indicated by an arrow in FIG. 3B. To be more specific, each groove 132 extends parallel to the moving direction (front-rear direction).

Each groove 132 has a front-rear length that is preferably equal to or greater than 80% of a front-rear length of the nip NP. Each groove 132 has a left-right width that can be set in a range of 0.2 mm to 0.3 mm. Each groove 132 has a depth (maximum depth) that can be set in a range of 0.05 mm to 0.3 mm.

In the present embodiment, two grooves 132 are formed at each of the left and right end portions of the contact surface 131. The two grooves 132 at each left-right end portion of the contact surface 131 are arranged in juxtaposition with each other in the left-right direction. More specifically, in the left-right direction, the grooves 132 are positioned inward of both ends 153 of the roller body 152 of the pressure roller 150 and outward of an image formable area PA of a sheet $P_{MAX}$ of a maximum size at which thermal fixation of the toner image can be achieved by the fixing device 100. In the present embodiment, the image formable area PA refers to an area within an image forming surface of the sheet $P_{MAX}$, to which the toner image can be transferred.

When, for example, a thickness of the nip plate 130 is set to 0.6 mm, and the front-rear length of the nip region NP is set to 10 mm, the front-rear length of the groove 132 can be set equal to or greater than 8 mm, the left-right width of the groove 132 can be set to 0.2 mm, and the depth (maximum depth) of the groove 132 can be set to 0.1 mm.

According to the present embodiment described above, the grease G enters the grooves 132 formed in the contact surface 131 and stays therein and therearound, thereby reducing fluidity of the grease G moving toward widthwise edges of the fusing belt 110. This prevents the grease G from leaking from the edges of the fusing belt 110.

Further, the grooves 132 are formed at positions inward of the both ends 153 of the pressure roller 150 in the left-right direction, so that a pressing force from the pressure roller 150 can be applied to portions of the nip plate 130 where the grooves 132 are formed. This makes it difficult for the grease G that has entered the grooves 132 to flow out from the grooves 132, thereby further preventing leakage of the grease G.

Further, the grooves 132 are formed at positions outward of the image formable area PA of the sheet $P_{MAX}$ in the left-right direction, so that influence of the formation of the grooves 132, i.e., a pattern of the grooves 132, does not appear in an image, allowing image quality to be improved.

Further, the grooves 132 extend parallel to the moving direction of the fusing belt 110. This allows satisfactory circular movement of the fusing belt 110 while preventing leakage of the grease G.

Variations of Nip Plate

Various variations to the nip plate 130 according to the first embodiment are conceivable. In the following description, only parts differing from those of the first embodiment will be described in detail.

Figure 4A:
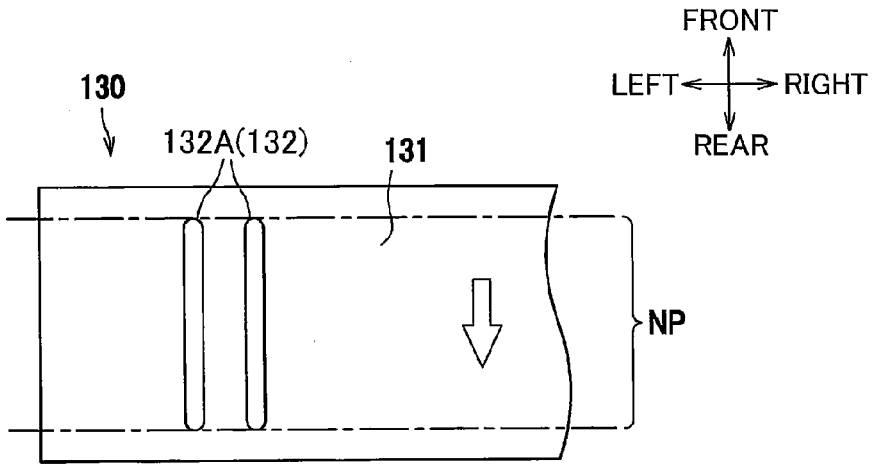
FIG. 4A is a bottom plan view of a left end portion of a nip plate according to a first variation of the first embodiment, showing a contact surface of the nip plate.
Figure 4B:
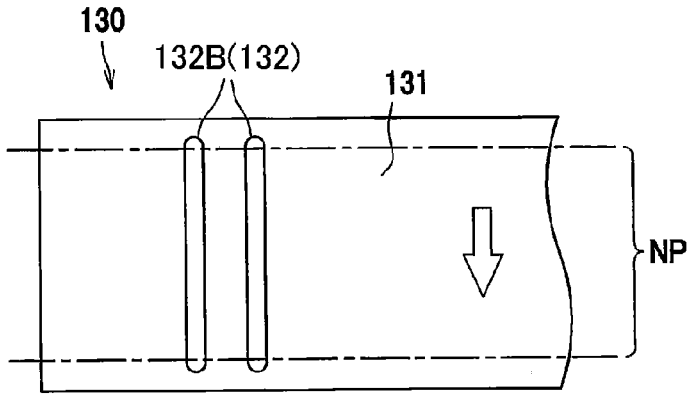
FIG. 4B is a bottom plan view of a left end portion of a nip plate according to a second variation of the first embodiment, showing a contact surface of the nip plate.

In FIG. 3B, the front-rear length of the grooves 132 is smaller than the front-rear length of the nip NP. However, the present invention is not limited to this. For example, as illustrated in FIG. 4A, the contact surface 131 may have a plurality of grooves 132A having a front-rear length equal to the front-rear length of the nip NP. That is, the front-rear length of the grooves 132A may be set to substantially 100% of the front-rear length of the nip NP. Further, as illustrated in FIG. 4B, the contact surface 131 may have a plurality of grooves 132B having a front-rear length greater than the front-rear length of the nip NP. Thus, the front-rear length of the grooves 132 may be equal to or greater than the front-rear length of the nip NP.

Figure 5A:
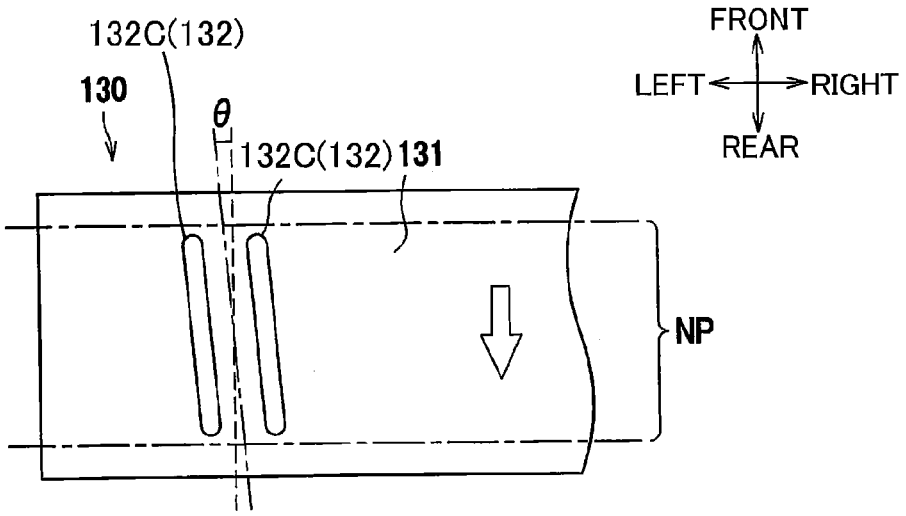
FIG. 5A is a bottom plan view of a left end portion of a nip plate according to a third variation of the first embodiment, showing a contact surface of the nip plate.

In FIG. 3B, the grooves 132 extend parallel to the moving direction of the fusing belt 110. However, the present invention is not limited to this. For example, as illustrated in FIG. 5A, the contact surface 131 may have a plurality of grooves 132C each extend at an angle equal to or smaller than 10 degrees (e.g., approximately 5 degrees to 10 degrees) with respect to the moving direction of the fusing belt 110. When the grooves 132C are inclined with respect to the front-rear direction such that a rear end of each groove 132C is positioned inward in the left-right direction than a front end thereof, effect of returning the grease G inward in the left-right direction may be brought about by circular movement of the fusing belt 110 that moves front to rear between the nip plate 130 and the pressure roller 150.

Figure 5B:
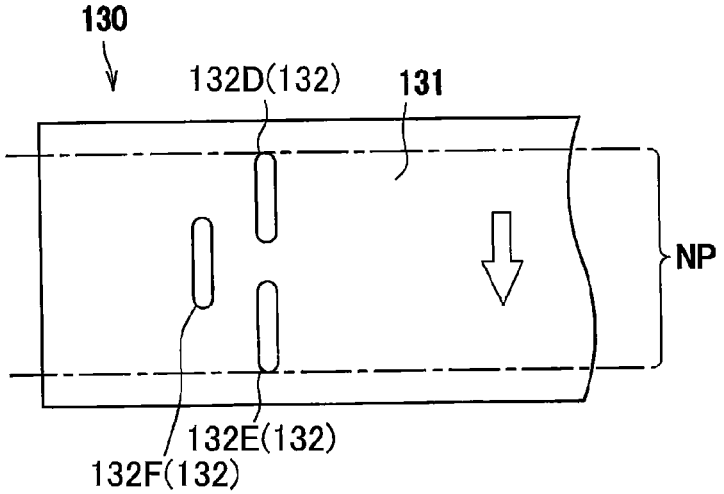
FIG. 5B is a bottom plan view of a left end portion of a nip plate according to a fourth variation of the first embodiment, showing a contact surface of the nip plate.

In FIG. 3B, the two grooves 132, each having the front-rear length equal to or greater than 80% of the front-rear length of the nip NP, are formed at each of the left and right end portions of the contact surface 131 and arranged in juxtaposition with each other in the left-right direction. However, the present invention is not limited to this. For example, as illustrated in FIG. 5B, the contact surface 131 may be formed with a first groove 132D, a second groove 132E, and a third groove 132F at each end portion thereof in the left-right direction. The second groove 132E is aligned with and spaced apart from the first groove 132D in the moving direction of the fusing belt 110. Specifically, the second groove 132E is positioned rearward of the first groove 132D. The third groove 132F is positioned outward in the left-right direction of the first and second grooves 132D and 132E and juxtaposed with a portion between the first and second grooves 132D and 132E in the left-right direction. As illustrated in FIG. 5B, the third groove 132F is formed such that a front end thereof is positioned frontward of a rear end of the first groove 132D and a rear end thereof is positioned rearward of a front end of the second groove 132E.

That is, the first and second grooves 132D and 132E in FIG. 5B are not continuous but discontinuous in the moving direction. Thus, strength of the nip plate 130 can be enhanced as compared to a case where the first and second grooves 132D and 132E are continuous in the moving direction, that is, a case where elongated grooves are formed in the contact surface 131. Further, movement of the grease G at the portion between the first and second grooves 132D and 132E can be blocked by the third groove 132F, thereby preventing leakage of the grease G.

Figure 6A:
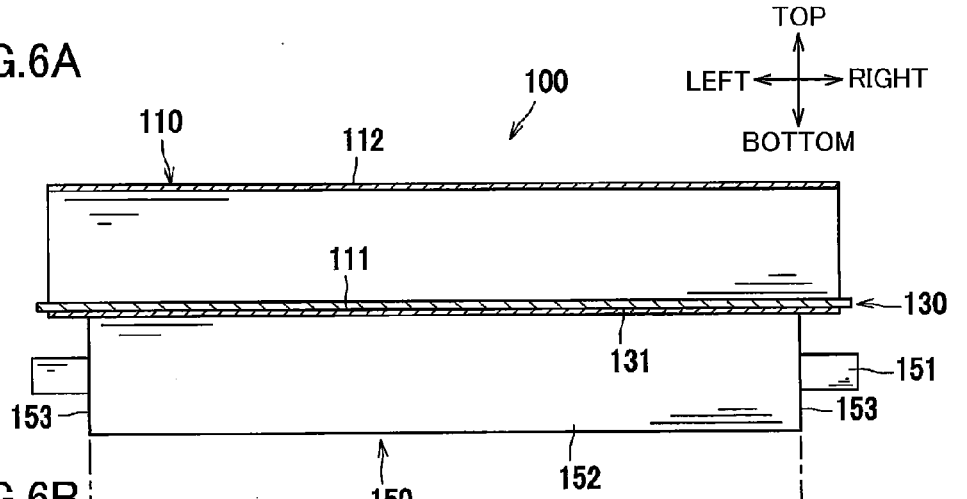
FIG. 6A is a cross-sectional view of the fixing device according to the first embodiment taken along a plane perpendicular to the front-rear direction.
Figure 6B:
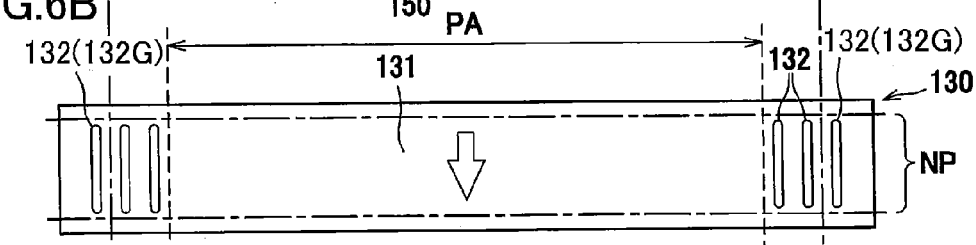
FIG. 6B is a bottom plan view of a nip plate according to a fifth variation of the first embodiment, showing a contact surface of the nip plate.
Figure 6C:
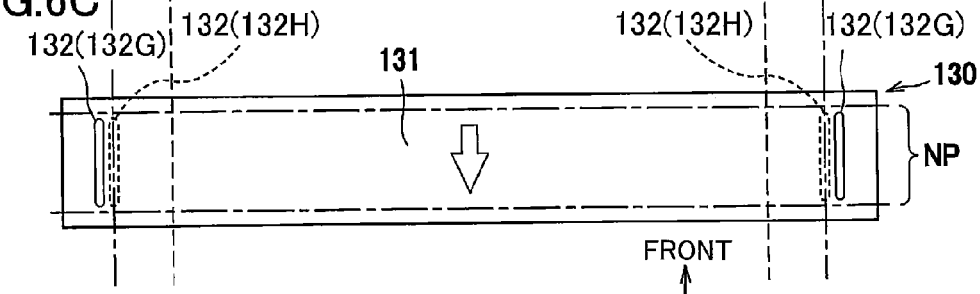
FIG. 6C is a bottom plan view of a nip plate according to a sixth variation of the first embodiment, showing a contact surface of the nip plate.

In FIG. 3B, in the left-right direction, the grooves 132 are positioned inward of the both ends 153 of the pressure roller 150 and outward of the image formable area PA. However, the present invention is not limited to this. For example, as illustrated in FIGS. 6A and 6B, in the left-right direction, the grooves 132 may be positioned not only between the both ends 153 of the pressure roller 150 and the image formable area PA of the sheet $P_{MAX}$, but also outward of the both ends 153 of the pressure roller 150. In FIG. 6B, in addition to the four grooves 132, two grooves 132G are formed in the contact surface 131 at positions outward in the left-right direction of the both ends 153 of the pressure roller 150. Further, as illustrated in FIGS. 6A and 6C, in the left-right direction, the grooves 132 may be positioned only outward of the both ends 153 of the pressure roller 150. In FIG. 6C, two grooves 132G are formed in the contact surface 131 only at positions outward in the left-right direction of the both ends 153 of the pressure roller 150.

With such configurations, a pressing force from the pressure roller 150 is not applied to portions of the fusing belt 110 that is brought into sliding contact with portions of the contact surface 131 where the grooves 132G are formed. Hence, leakage of the grease G can be prevented without applying stress on the fusing belt 110. Further, as indicated by a dashed line in FIG. 6C, in the left-right direction, the grooves 132H may be formed at positions in alignment with the both ends 153 of the pressure roller 150.

Figure 6D:
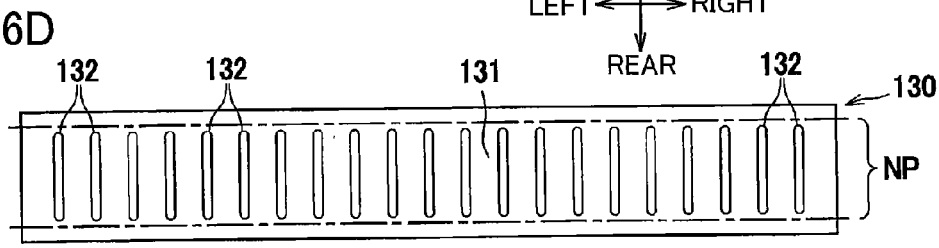
FIG. 6D is a bottom plan view of a nip plate according to a seventh variation of the first embodiment, showing a contact surface of the nip plate.

In FIG. 3B, in the left-right direction, the grooves 132 are formed in the contact surface 131 at positions outside the image formable area PA of the sheet $P_{MAX}$. However, the present invention is not limited to this. The grooves 132 may be formed in the contact surface 131 within the image formable area PA. In this case, as illustrated in FIG. 6D, three or more grooves 132 may be arranged at equal intervals or, although not illustrated, at unequal intervals, in the left-right direction. Arranging the grooves 132 at equal intervals can make an amount of the grease G between the neighboring grooves 132 substantially equal, so that satisfactory circular movement of the fusing belt 110 can be obtained.

2. Second Embodiment

Next, a second embodiment of the present invention will be described while referring to FIGS. 7A through 7C, wherein like parts and components are designated by the same reference numerals to avoid duplicating description.

Figures 7A, 7B, 7C:
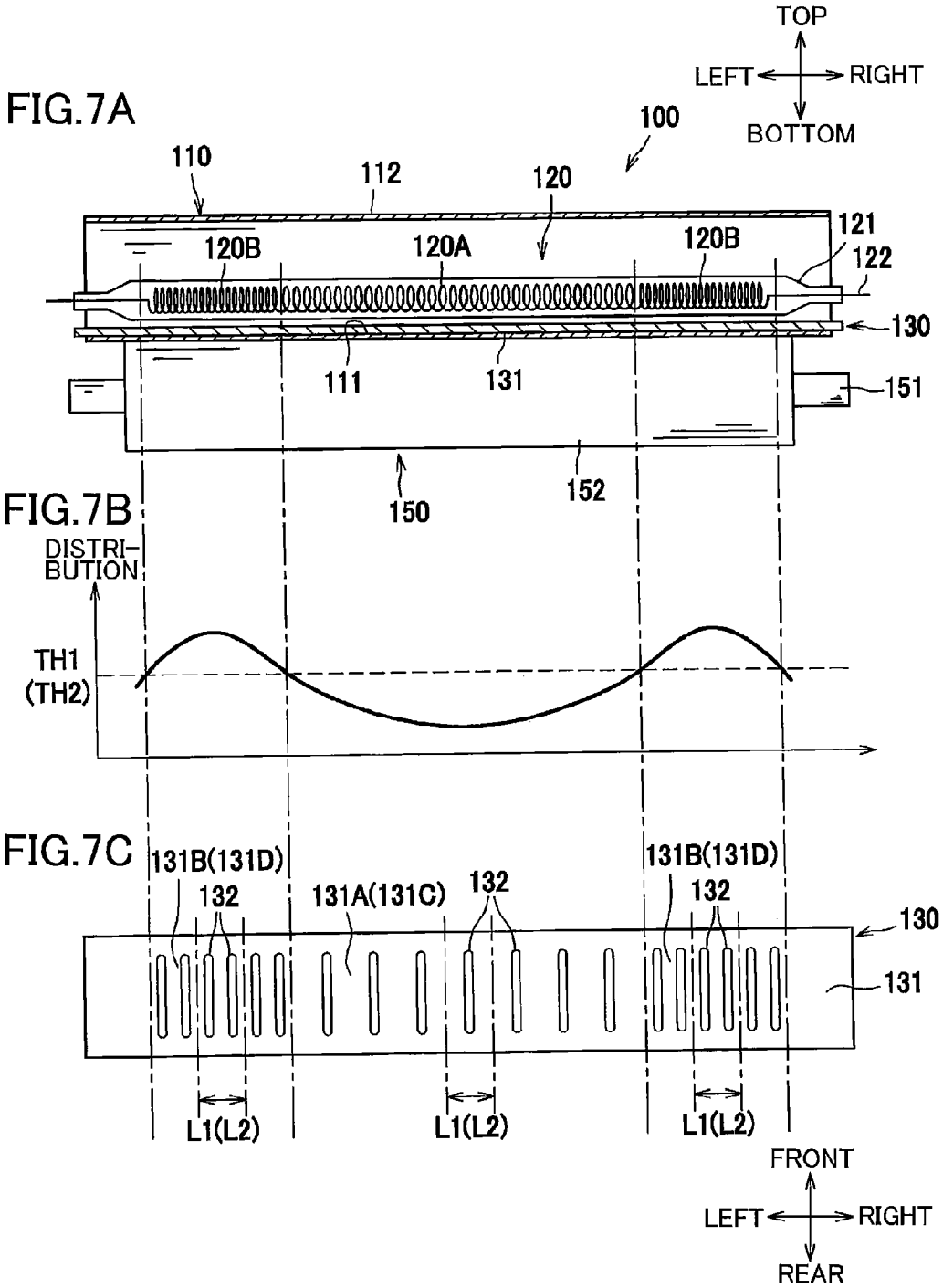
FIG. 7A is a cross-sectional view of a fixing device according to second and third embodiments of the present invention taken along a plane perpendicular to the front-rear direction.
FIG. 7B is a view illustrating distribution of a heating value of a halogen lamp of the fixing device according to the second embodiment and distribution of a pressing force of a pressure roller of the fixing device according to the third embodiment.
FIG. 7C is a bottom plan view of a nip plate of the fixing device according to the second and third embodiments, showing a contact surface of the nip plate.

As illustrated in FIGS. 7A and 7B, the halogen lamp 120 includes a first heat generating portion 120A and second heat generating portions 120B. The first heat generating portion 120A is configured to generate heat at a heating value equal to or smaller than a predetermined heating value TH1. The second heat generating portions 120B are configured to generate heat at a heating value greater than the predetermined heating value TH1.

More specifically, the second heat generating portions 120B are provided on both sides of the first heat generating portion 120A in the left-right direction. The second heat generating portions 120B are each configured such that the number of windings per unit length of the filament 122 in the left-right direction is greater than that of the first heat generating portion 120A. That is, the filament 122 is wound more densely in the second heat generating portions 120B at both left and right end portions of the halogen lamp 120 than in the first heat generating portion 120A at a left-right center portion of the halogen lamp 120.

As illustrated in FIGS. 7A and 7C, the contact surface 131 of the nip plate 130 includes a first portion 131A and second portions 131B. The first portion 131A corresponds to the first heat generating portion 120A, and the second portions 131B correspond to the second heat generating portions 120B. Thus, the second portions 131B are provided on both sides of the first portion 131A in the left-right direction. More specifically, the first portion 131A faces the first heat generating portion 120A, and the second portions 131B face the second heat generating portions 120B. The first and second portions 131A and 131B are each formed with a plurality of grooves 132 extending in the moving direction of the fusing belt 110 (front-rear direction) and arranged in juxtaposition with each other in the left-right direction.

As illustrated in FIG. 7C, the first portion 131A has a region of a first length L1 in the left-right direction, and each of the second portions 131B has a region of a first length L1 in the left-right direction. The number of the grooves 132 formed in the region of the first length L1 in the second portion 131B is greater than the number of the grooves 132 formed in the region of the first length L1 in the first portion 131A. More specifically, two grooves 132 are formed in the region of the first length L1 in the second portion 131B, and one groove 132 is formed in the region of the first length L1 in the first portion 131A.

In the present embodiment, the first length L1 may be a length within which at least two grooves 132 of the second portion 131B can be formed. Further, the number of the grooves 132 formed in the region of the first length L1 implies the number of the grooves 132 each of which is positioned entirely within the region and does not include the number of the grooves 132 only a part of each of which is positioned within the region.

According to the second embodiment described above, as in the first embodiment, the grease G enters the grooves 132 and stays therein and therearound, thereby reducing fluidity of the grease G moving toward the edges of the fusing belt 110. This prevents the grease G from leaking from the edges of the fusing belt 110.

Further, the second portions 131B facing the second heat generating portions 120B of the halogen lamp 120 tend to be higher in temperature than the first portion 131A facing the first heat generating portion 120A of the halogen lamp 120. Accordingly, the grease G in the second portions 131B is more likely to decrease in its viscosity and thus to increase in fluidity than the grease G in the first portion 131A. However, in the present embodiment, the grooves 132 are densely formed in the second portions 131B more than in the first portion 131A, so that the grease G can be made to stay at the grooves 132 more densely formed in the second portions 131B, thereby effectively preventing movement of the grease G having high fluidity. Particularly, in the present embodiment, the second portions 131B are provided at both the left and right end portions of the contact surface 131, so that leakage of the grease G from the edges of the fusing belt 110 can be prevented more effectively.

In the present embodiment, the grooves 132 are formed both in the first and second portions 131A and 131B of the contact surface 131. However, the present invention is not limited to this. For example, the grooves 132 may not be formed in the first portion 131A. In this case, the first length L1 may be a length within which at least one groove 132 of the second portion 131B can be formed.

A distribution of the heating value illustrated in FIG. 7B is exemplary. That is, in FIG. 7B, the heating value of the halogen lamp 120 is greater at the both left and right end portions of the halogen lamp 120 than at the left-right center portion thereof. However, the present invention is not limited to this. For example, the heating value may be greater at the left-right center portion of the halogen lamp 120 than at the both left and right end portions thereof.

3. Third Embodiment

Next, a third embodiment of the present invention will be described while referring to FIGS. 7A through 7C, wherein like parts and components are designated by the same reference numerals to avoid duplicating description.

As illustrated in FIGS. 7B and 7C, the contact surface 131 of the nip plate 130 includes a third portion 131C and fourth portions 131D. The fourth portions 131D are provided on both sides of the third portion 131C in the left-right direction. The third portion 131C receives a pressing force equal to or smaller than a predetermined pressing force TH2 from the pressure roller 150. The fourth portions 131D each receive a pressing force greater than the predetermined pressing force TH2 from the pressure roller 150. The third and fourth portions 131C and 131D are each formed with a plurality of grooves 132 extending in the moving direction of the fusing belt 110 (front-rear direction) and arranged in juxtaposition with each other in the left-right direction.

As illustrated in FIG. 7C, the third portion 131C has a region of a second length L2 in the left-right direction, and each of the fourth portions 131D has a region of a second length L2 in the left-right direction. The number of the grooves 132 formed in the region of the second length L2 in the fourth portion 131D is greater than the number of the grooves 132 formed in the region of the second length L2 in the third portion 131C. More specifically, two grooves 132 are formed in the region of the second length L2 in the fourth portion 131D, and one groove 132 is formed in the region of the second length L2 in the third portion 131C.

In the present embodiment, the second length L2 may be a length within which at least two grooves 132 of the fourth portion 131D can be formed. Further, the number of the grooves 132 formed in the region of the second length L2 implies the number of the grooves 132 each of which is positioned entirely within the region and does not include the number of the grooves 132 only a part of each of which is positioned within the region.

According to the third embodiment described above, as in the first embodiment, the grease G enters the grooves 132 and stays therein and therearound, thereby reducing fluidity of the grease G moving toward the edges of the fusing belt 110. This prevents the grease G from leaking from the edges of the fusing belt 110.

Further, the fourth portions 131D receive the pressing force from the pressure roller 150 greater than that received by the third portion 131C, causing the grease D that has not entered the grooves 132 to be likely to move toward the edges of the fusing belt 110. However, in the present embodiment, the grooves 132 are densely formed in the fourth portions 131D more than in the third portion 131C, so that the grease G can be made to stay at the grooves 132 more densely formed in the fourth portions 131D, thereby effectively preventing movement of the grease G. This effectively prevents leakage of the grease G. Particularly, in the present embodiment, the fourth portions 131D are provided at both the left and right end portions of the contact surface 131, so that leakage of the grease G from the edges of the fusing belt 110 can be prevented more effectively.

In the present embodiment, the grooves 132 are formed both in the third and fourth portions 131C and 131D of the contact surface 131. However, the present invention is not limited to this. For example, the grooves 132 may not be formed in the third portion 131C. In this case, the second length L2 may be a length within which at least one groove 132 of the fourth portion 131D can be formed.

A distribution of the pressing force illustrated in FIG. 7B is exemplary. That is, in FIG. 7B, the pressing force to be applied from the pressure roller 150 to the contact surface 131 is greater at the both left and right end portions of the contact surface 131 than at the left-right center portion thereof. However, the present invention is not limited to this. For example, the pressing force may be greater at the left-right center portion of the contact surface 131 than at the both left and right end portions thereof.

4. Modifications of First to Third Embodiments

While the present invention has been described in detail with reference to the first to third embodiments thereof, it would be apparent to those skilled in the art that various changes and modifications may be made therein without departing from the spirit of the present invention. In the following description, only parts differing from those of the first to third embodiments will be described in detail.

The number of the grooves 132 described in the above embodiments is exemplary. The present invention can prevent the lubricant from leaking from the edges of the fusing belt 110 as long as the contact surface 131 that can be brought into sliding contact with the inner peripheral surface 111 of the fusing belt 110 has at least one groove 132 at each end portion of the fusing belt 110 in the widthwise direction.

In the above embodiments, the grooves 132 each have the same length and width. However, the present invention is not limited to this. For example, in the configuration illustrated in FIG. 5B, the front-rear length of the third groove 132F may be smaller than that of the first and second grooves 132D and 132E. Further, in the configuration illustrated in FIG. 5B, the third groove 132F may be positioned further inward in the left-right direction than the first and second grooves 132D and 132E.

Figure 8A:
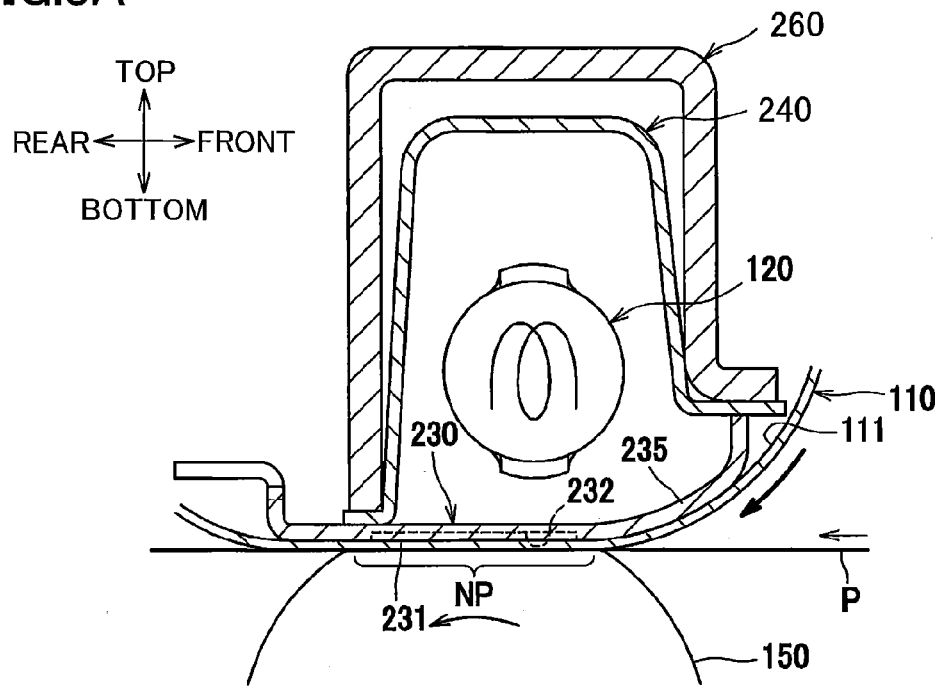
FIGS. 8A through 8C are cross-sectional views of a fixing device according to one modification of the first to third embodiments.

In the above embodiments, the flat-plate shaped nip plate 130 is employed as the nip member. However, the present invention is not limited to this. For example, as illustrated in FIG. 8A, a nip plate 230 as an example of the nip member may be formed to have a cross-section in which a front end portion 235 thereof is bent upward. In this case, front walls of a reflection member 240 and a stay 260 are offset upward relative to their rear walls. In such a configuration, the fusing belt 110 can be preheated before the fusing belt 110 enters between the nip plate 230 and the pressure roller 150. The nip plate 230 has a contact surface 231 that can be brought into sliding contact with the inner peripheral surface 111 of the fusing belt 110 through the grease G. The contact surface 231 has a plurality of grooves 232 at both end portions thereof in the widthwise direction of the fusing belt 110 (left-right direction).

In the configuration illustrated in FIG. 8A, the front-rear length of the grooves 232 is smaller than that of the nip NP. With this configuration, the grease G can be suitably retained by the grooves 232.

Figure 8B:
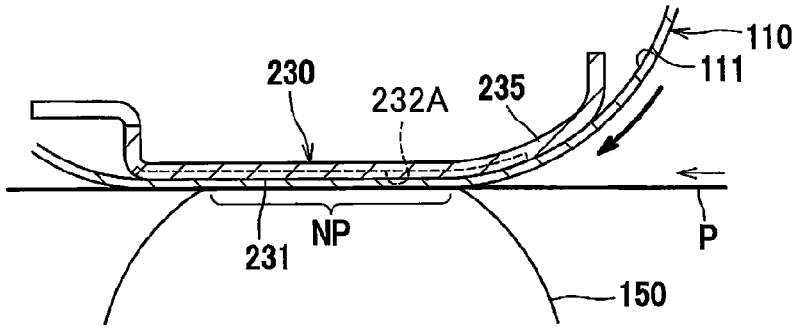

Further, as illustrated in FIG. 8B, the contact surface 231 has a plurality of grooves 232A, each of which has a front-rear length that is greater than that of the nip NP. With this configuration, the grease G flowing out from rear ends (i.e. downstream ends in the moving direction of the fusing belt 110) of the grooves 232A in accordance with circular movement of the fusing belt 110 can be made to enter smoothly between the fusing belt 110 and the contact surface 231 from front ends (i.e. upstream ends in the moving direction of the fusing belt 110) of the grooves 232A, thereby allowing the grease G between the fusing belt 110 and the contact surface 231 to be circulated suitably.

Figure 8C:
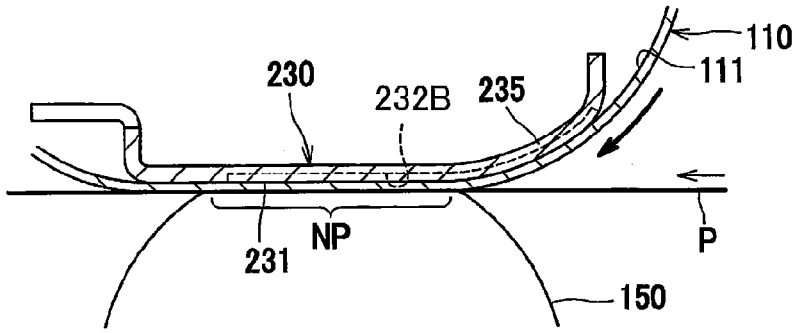

Further, as illustrated in FIG. 8C, the contact surface 231 has a plurality of grooves 232B whose front end portions are positioned frontward of a front end of the nip NP. With this configuration, the grease G can be retained in the grooves 232B, and the grease G adhered to the inner peripheral surface 111 of the fusing belt 110 can be made to enter smoothly between the fusing belt 110 and the contact surface 231 from front ends (i.e. upstream ends in the moving direction of the fusing belt 110) of the grooves 232B.

In the above embodiments, the fixing device 100 configured such that the halogen lamp 120 heats the nip plate 130 to heat the fusing belt 110 through the nip plate 130 is employed. Thus, in the fixing device 100, the fusing belt 110 is heated by the halogen lamp 120 through the nip plate 130. However, the present invention is not limited to this. For example, as illustrated in FIG. 9A, a fixing device 300 configured such that the fusing belt 110 is directly heated by the halogen lamp 120 may be available.

More specifically, in the fixing device 300, a nip plate 330 is formed into a U-shaped plate-like shape in cross-section and is disposed in the internal space of the fusing belt 110 so as to be spaced apart from the halogen lamp 120. Further, the nip plate 330 has a contact surface 331 that can be brought into sliding contact with the inner peripheral surface 111 of the fusing belt 110 through the grease G. The contact surface 331 has a plurality of grooves 332 at both end portions thereof in the widthwise direction of the fusing belt 110 (left-right direction).

In the fixing device 300, a reflection member 340, a support member 360, and a heat insulation member 370 are disposed between the halogen lamp 120 and the nip plate 330. The reflection member 340 is a member that reflects heat from the halogen lamp 120 toward the fusing belt 110. The support member 360 is a member that supports the nip plate 330 and the reflecting member 340. The heat insulation member 370 is formed of resin such as a liquid crystal polymer and prevents the heat from the halogen lamp 120 from being directly transmitted to the nip plate 330.

Figure 9A:
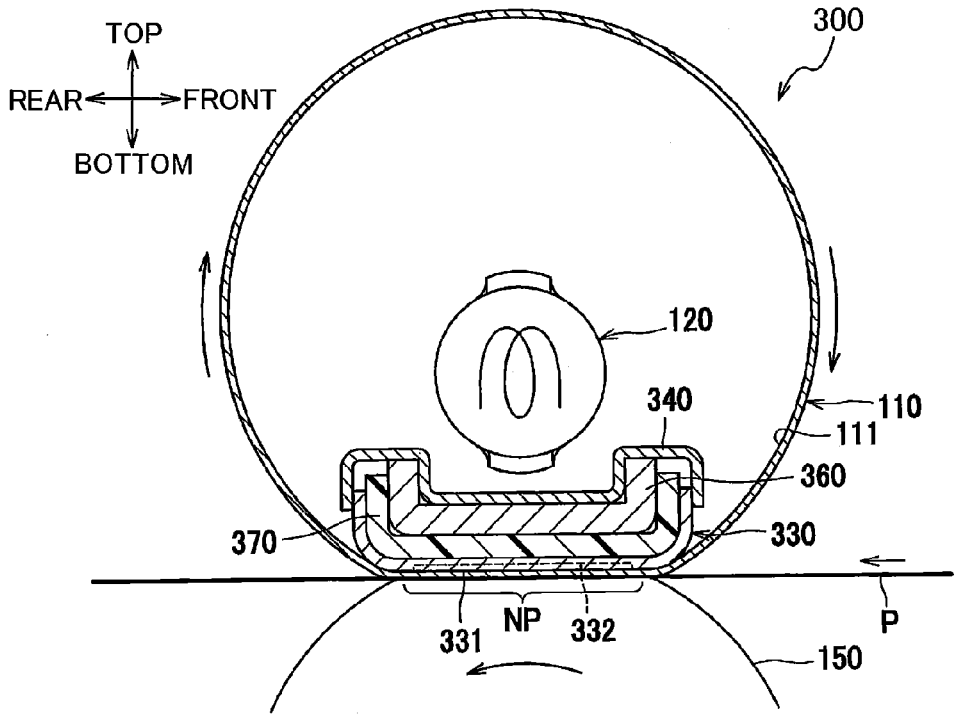
FIGS. 9A through 9C are cross-sectional views of a fixing device according to another modification of the first to third embodiments.

In the configuration illustrated in FIG. 9A, the front-rear length of the grooves 332 is smaller than that of the nip NP. With this configuration, the grease G can be suitably retained by the grooves 332.

Figure 9B:
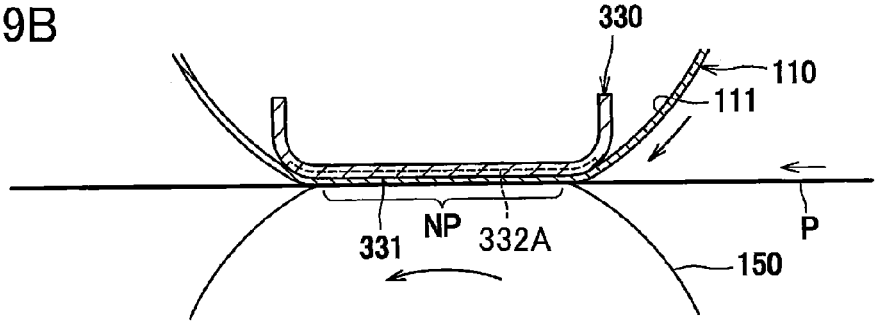

Further, as illustrated in FIG. 9B, the contact surface 331 has a plurality of grooves 332A, each of which has a front-rear length that is greater than that of the nip NP. With this configuration, the grease G can be circulated suitably as in the configuration illustrated in FIG. 8B.

Figure 9C:
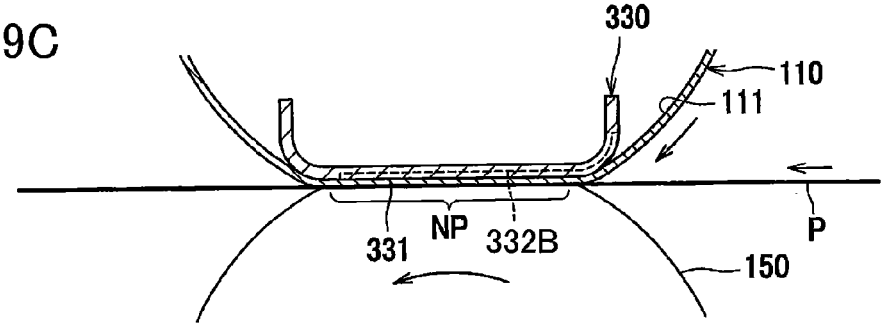

Further, as illustrated in FIG. 9C, the contact surface 331 has a plurality of grooves 332B whose front end portions are positioned frontward of a front end of the nip NP. With this configuration, the grease G can be retained in the grooves 332B and made to enter smoothly between the fusing belt 110 and the contact surface 331 as in the configuration illustrated in FIG. 8C.

In the above embodiments, the halogen lamp 120 is employed as a heater. However, the present invention is not limited to this. For example, a carbon heater is available as the heater.

In the above embodiments, the plate-like nip plate 130 is employed as a nip member. However, the present invention is not limited to this. For example, the nip member may be a thick member, not the plate-like member.

In the above embodiments, the pressure roller 150 is employed as a backup member. However, the present invention is not limited to this. For example, the backup member may be a belt-like pressure member.

In the above embodiments, the laser printer 1 that forms a monochromatic image on the sheet P is employed as an image forming apparatus provided with the fixing device according to the present invention. However, the present invention is not limited to this. For example, the image forming apparatus may be a printer capable of forming a color image on a sheet. Further, the image forming apparatus is not limited to the printer, but may be a copying machine or a multifunction machine provided with a document reader such as a flat-bed scanner.

In the above embodiments, the sheet P such as a regular paper or a postcard is employed as a recording sheet. However, the present invention is not limited to this. For example, an OHP sheet may be available as the recording sheet.

5. Fourth Embodiment

General Structure of Laser Printer

Figure 10:
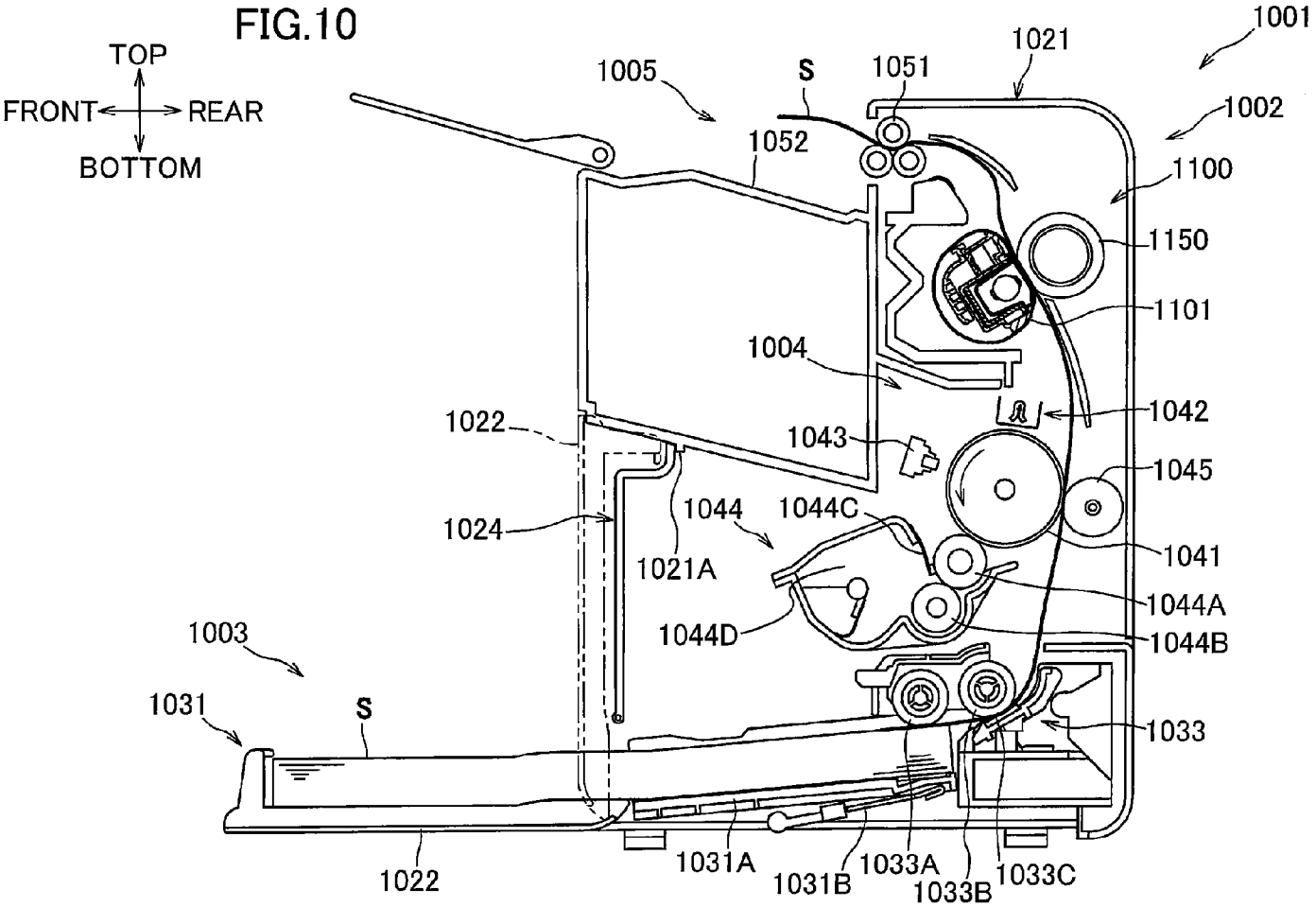
FIG. 10 is a cross-sectional view of a laser printer provided with a fixing device according to a fourth embodiment of the present invention.

Next, a general structure of a laser printer 1001 as an image forming apparatus provided with a fixing device 1100 according to a fourth embodiment of the present invention will be described with reference to FIG. 10. A detailed structure of the fixing device 1100 according to the fourth embodiment will be described later while referring to FIGS. 11 through 14D, wherein like parts and components are designated by the same reference numerals to avoid duplicating description.

In the following description (fourth embodiment and modifications thereof), the terms "upward", "downward", "upper", "lower", "above", "below", "beneath", "right", "left", "front", "rear" and the like will be used assuming that the laser printer 1001 is disposed in an orientation in which it is intended to be used. More specifically, a left side and a right side in FIG. 10 are a front side and a rear side, respectively. Further, a far side and a near side in FIG. 10 are a left side and a right side, respectively. That is, the left and right sides of the laser printer 1001 will be based on the perspective of a user facing the front side of the laser printer 1001. Further, a top side and a bottom side in FIG. 10 are a top side and a bottom side, respectively.

The laser printer 1001 is configured to transfer a toner image (developer image) formed on a photosensitive drum 1041 (described later) onto a sheet of paper S to thereby form an image on the sheet S as an example of a recording sheet. The laser printer 1001 includes a casing 1002, a sheet supply unit 1003, an image forming unit 1004, and a sheet discharge unit 1005.

The casing 1002 includes a main frame 1021 that supports the photosensitive drum 1041, and a first front cover 1022. The main frame 1021 has a front wall that is formed with an opening 1021A through which a developing cartridge 1044 (described later) is attached to and detached from the casing 1002.

The first front cover 1022 is a cover (indicated by a long dashed double-short dashed line in FIG. 10) that covers the opening 1021A. The first front cover 1022 is supported to the main frame 1021 such that an upper end portion of the first front cover 1022 is pivotally movable about a lower end portion thereof. Hence, the first front cover 1022 is movable between an open state indicated by a solid line in FIG. 10 and a closed state indicated by a long dashed double-short dashed line in FIG. 10. The first front cover 1022 in the open state constitutes a part of a sheet supply tray 1031 (described later). The casing 1002 further includes a second front cover 1024. The second front cover 1024 is supported to the main frame 1021 at a position further inward of the first front cover 1022 in the closed state. The second front cover 1024 is pivotally movable about its lower end portion to open and close the opening 1021A. With this configuration, even when the first front cover 1022 is opened and used as a part of the sheet supply tray 1031, dust can be prevented from entering the casing 1002 by the second front cover 1024.

The sheet supply unit 1003 is adapted to supply the sheets S to the image forming unit 1004. The sheet supply unit 1003 includes the sheet supply tray 1031 and a sheet supplying mechanism 1033. The sheet supply tray 1031 is a tray on which the sheets S to be supplied to the image forming unit 1004 are stacked.

The sheet supply tray 1031 has a sheet stacked portion for stacking the sheets S thereon. The sheet stacked portion is constituted by the first front cover 1022 in the opened state and a lifter plate 1031A. The lifter plate 1031A is provided in a lower portion of the casing 1002. The lifter plate 1031A is supported to the main frame 1021 such that a rear end portion of the lifter plate 1031A is vertically pivotally movable about a front end portion thereof. The rear end portion of the lifter plate 1031A is pushed upward by a pushing member 1031B.

The sheet supplying mechanism 1033 includes a pickup roller 1033A, a separating roller 1033B, and a separating pad 1033C. The sheet supplying mechanism 1033 is disposed at a lower rear portion of the casing 1002. The sheet supplying mechanism 1033 is adapted to feed the sheets S stacked on the sheet supply tray 1031 by the pickup roller 1033A, to separate the sheets S from one another between the separating roller 1033B and the separating pad 1033C, and to supply the separated sheets S one by one to the image forming unit 1004.

The image forming unit 1004 is adapted to form an image on the sheet S fed thereto. The image forming unit 1004 includes the photosensitive drum 1041 as an example of an image carrier, a charging unit 1042, an exposing unit 1043, the developing cartridge 1044, a transfer roller 1045 as an example of a transfer member, and the fixing device 1100.

The photosensitive drum 1041 includes a cylindrical drum body having electrical conductivity. A photosensitive layer is formed over an outer peripheral surface of the cylindrical drum body. The photosensitive drum 1041 is disposed on a rear portion of the casing 1002 at a vertical center portion thereof. The photosensitive drum 1041 is rotatable in a direction indicated by an arrow in FIG. 10. Toner (developer) is supplied to an electrostatic latent image formed by exposure on the photosensitive drum 1041 to thereby form a toner image as an example of a developer image. The toner image is carried on the photosensitive drum 1041.

The charging unit 1042 includes a corona wire, a grid electrode, and the like. The charging unit 1042 is disposed above the photosensitive drum 1041 so as to face the photosensitive drum 1041. The charging unit 1042 is adapted to uniformly charge the outer peripheral surface of the photosensitive drum 1041 by application of a charging bias.

The exposing unit 1043 has a plurality of blinking portions (light-emitting diode elements, not illustrated) arrayed in a left-right direction which is an axial direction of the photosensitive drum 1041. That is, a rotation axis of the photosensitive drum 1041 extends in the left-right direction. The exposing unit 1043 is disposed diagonally above and frontward of the photosensitive drum 1041 so as to face the photosensitive drum 1041. The exposing unit 1043 is adapted to expose the uniformly charged surface of the photosensitive drum 1041 to light by the plurality of blinking portions blinking based on image data.

The developing cartridge 1044 includes a developing roller 1044A, a supply roller 1044B, a layer thickness regulating blade 1044C, and a toner chamber 1044D for accommodating the toner therein. The developing cartridge 1044 is disposed diagonally below and frontward of the photosensitive drum 1041 so as to face the photosensitive drum 1041. The developing cartridge 1044 is adapted to supply the toner to the electrostatic latent image formed by exposure on the photosensitive drum 1041 to form the toner image on the photosensitive drum 1041. Opening the first front cover 1022 and the second front cover 1024 allows the developing cartridge 1044 to be detached from and attached to the casing 1002 through the opening 1021A. With this configuration, the developing cartridge 1044 can be replaced with a new one.

The transfer roller 1045 includes a metallic shaft and an elastic roller body formed over the shaft. The transfer roller 1045 is disposed rearward of the photosensitive drum 1041 so as to face the photosensitive drum 1041. The transfer roller 1045 is adapted to transfer the toner image onto the sheet S passing between the transfer roller 1045 and the photosensitive drum 1041 by attracting the toner to the sheet S by application of a transfer bias.

The fixing device 1100 includes a heating member 1101 and a pressure roller 1150. The fixing device 1100 is disposed, inside the casing 1002, above the photosensitive drum 1041. The fixing device 1100 is adapted to thermally fix the toner image that has been transferred onto the sheet S while the sheet S passes between the heating member 1101 and the pressure roller 1150. Details of the fixing device 1100 will be described later.

The sheet discharge unit 1005 is adapted to discharge the sheet S on which an image has been formed. The sheet discharge unit 1005 includes a discharge roller 1051 and a discharge tray 1052. The discharge roller 1051 is a roller for discharging the sheet S conveyed from the fixing device 1100 to outside the casing 1002. The discharge roller 1051 is disposed at an upper portion of the casing 1002. The discharge tray 1052 is adapted for placing the sheet S that has been discharged by the discharge roller 1051 to outside the casing 1002. The discharge tray 1052 is formed on an upper surface of the main frame 1021.

The laser printer 1001 having the above-described configuration starts an image forming operation upon reception of an image forming instruction including image data. More specifically, in the image forming unit 1004, the charging unit 1042 applies a charge to the surface of the rotating photosensitive drum 1041, and then, the exposing unit 1043 exposes the charged surface of the photosensitive drum 1041 to light. As a result, an electrostatic latent image based on image data is formed on the surface of the photosensitive drum 1041. Thereafter, the developing cartridge 1044 supplies the toner to the exposed surface of the photosensitive drum 1041 to visualize the electrostatic latent image thereon. Hence, a toner image is formed on the surface of the photosensitive drum 1041.

At an appropriate timing in the image forming operation, in the sheet supply unit 1003, the sheet supplying mechanism 1033 supplies, to the image forming unit 1004, the sheet S placed on the sheet supply tray 1031. In the image forming unit 1004, the toner image carried on the surface of the photosensitive drum 1041 is transferred onto the sheet S supplied from the sheet supply unit 1003 while the sheet S is conveyed between the photosensitive drum 1041 and the transfer roller 1045. Subsequently, the fixing device 1100 thermally fixes the transferred toner image on the sheet S. Then, the sheet S on which the toner image has been thermally fixed is conveyed to the sheet discharge unit 1005. The sheet S is discharged by the discharge roller 1051 to outside the casing 1002 and placed onto the discharge tray 1052.

General Structure of Fixing Device

Figure 11:
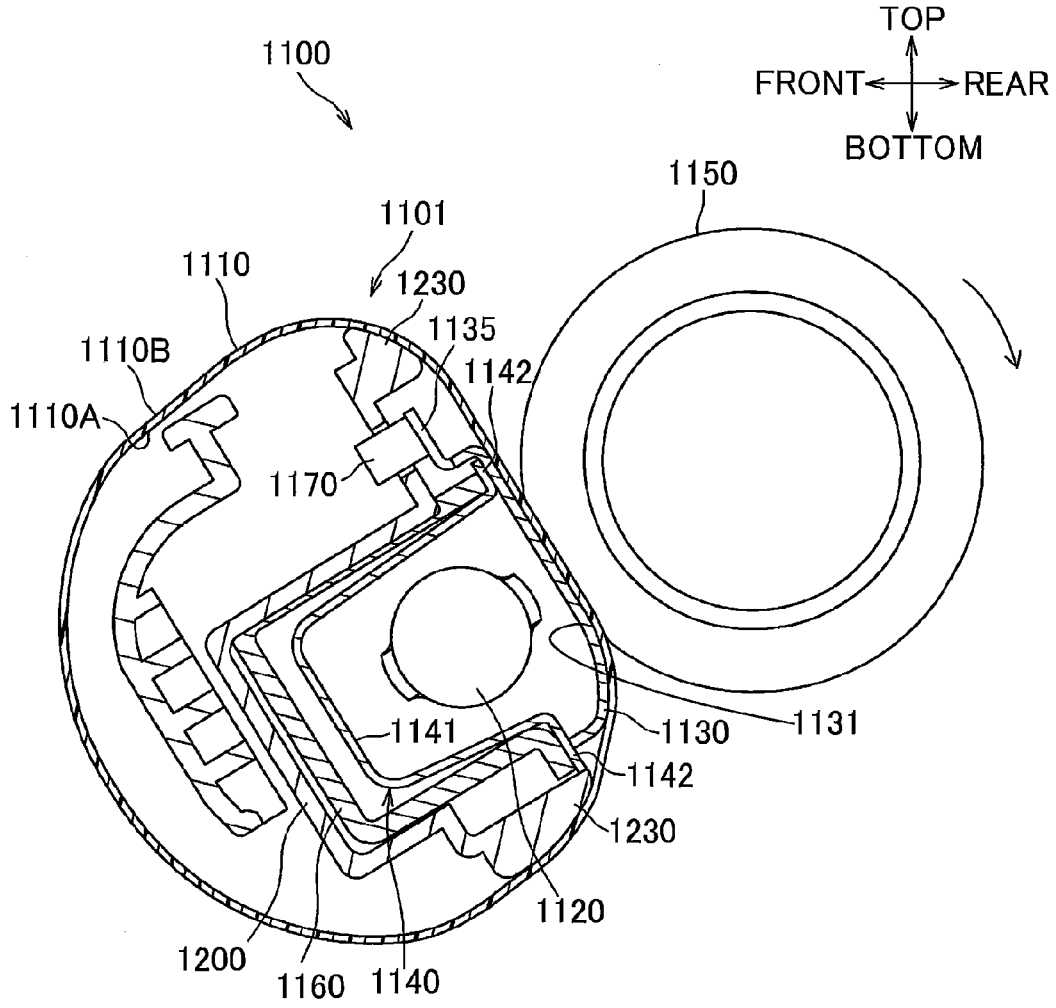
FIG. 11 is a cross-sectional view of the fixing device according to the fourth embodiment.

Next, a detailed structure of the fixing device 1100 will be described. As illustrated in FIG. 11, the fixing device 1100 includes the heating member 1101 and the pressure roller 1150 as an example of a backup member.

The heating member 1101 includes a fusing belt 1110, a halogen lamp 1120 as an example of a heater, a nip plate 1130 as an example of a nip member, a reflection plate 1140, a stay 1160, and a guide frame 1200.

The fusing belt 1110 is an endless belt having heat resistance and flexibility. While contacting the pressure roller 1150 rotating in a clockwise direction illustrated in FIG. 11, the fusing belt 1110 is circularly moved such that a portion of the fusing belt 1110 nipping the sheet S in cooperation with the pressure roller 1150 moves in a direction from a lower rear side to an upper front side. That is, at a nip region where the sheet S is nipped between the fusing belt 1110 and the pressure roller 1150, the fusing belt 1110 moves diagonally above and frontward. The fusing belt 1110 is configured to be circularly moved about an axis thereof extending in a left-right direction (i.e. widthwise direction). The fusing belt 1110 has an inner surface 1110A slidably contacting the nip plate 1130, and an outer surface 1110B facing the pressure roller 1150. The fusing belt 1110 has a metallic tube formed of metal such as stainless steel. Further, the fusing belt 1110 may have a rubber layer covering a surface of the metallic tube. The fusing belt 1110 may further have a non-metallic layer formed of an easily separable material, such as fluorine coating, over a surface of the rubber layer.

The halogen lamp 1120 is provided separately from the nip plate 1130. The halogen lamp 1120 is a heater heating the nip plate 1130 and the fusing belt 1110 to thereby heat the toner on the sheet S. The halogen lamp 1120 is disposed in an internal space defined by the fusing belt 1110 so as to be spaced apart by a predetermined interval from the inner surface 1110A of the fusing belt 1110 and an inner surface (i.e. surface facing the halogen lamp 1120) of the nip plate 1130.

The nip plate 1130 is formed of a metallic plate that is elongated in the left-right direction. The nip plate 1130 is formed by bending, for example, an aluminum plate having heat conductivity higher than that of the stay 1160 (described later) made of steel. The nip plate 1130 is disposed such that the inner surface 1110A of the fusing belt 1110 is in sliding contact with the nip plate 1130. The nip plate 1130 is adapted to transmit radiant heat received from the halogen lamp 1120 to the toner on the sheet S through the fusing belt 1110. The structure of the nip plate will be described later in detail.

The reflection plate 1140 is a member for reflecting the radiant heat from the halogen lamp 1120 toward the nip plate 1130. More specifically, the reflection plate 1140 is adapted to reflect, toward an inner surface of a base portion 1131 (described later) of the nip plate 1130, the radiant heat radiated from the halogen lamp 1120 toward a reflecting portion 1141 (described later) of the reflection plate 1140. The reflection plate 1140 is disposed in the internal space of the fusing belt 1110 so as to be spaced apart by a predetermined interval from the halogen lamp 1120 and to surround the halogen lamp 1120.

Thus, the radiant heat from the halogen lamp 1120 can be efficiently concentrated onto the nip plate 1130 by the reflection plate 1140 to promptly heat the nip plate 1130 and the fusing belt 1110.

The reflection plate 1140 is formed into a substantially U-shaped cross-section by bending, for example, an aluminum plate having a high reflection ratio regarding an infrared ray and a far-infrared ray. More specifically, the reflection plate 1140 has the reflecting portion 1141 having a curved shape (substantially U-shaped cross-section), and flange portions 1142 respectively bent outward at substantially right angles at both ends of the reflecting portion 1141 and extending from both ends of the reflecting portion 1141 in an upper-frontward/lower-rearward direction. In order to enhance the heat reflection ratio of the reflection plate 1140, the reflection plate 1140 may be formed of an aluminum plate to which a mirror surface finishing is applied.

The stay 1160 is a member that supports both end portions of the nip plate 1130 in a sheet conveying direction of the sheet S through the flange portions 1142 of the reflection plate 1140, respectively, to thereby ensure rigidity of the nip plate 1130. The stay 1160 is formed into a substantially U-shape in cross-section and disposed so as to surround the reflection plate 1140.

The guide frame 1200 is a member that supports a component such as a plurality of temperature sensors 1170 for detecting a temperature of the nip plate 1130 for temperature control of the fixing device 1100. The guide frame 1200 is fixed to the stay 1160. Incidentally, each of the plurality of temperature sensors 1170 is disposed so as to face corresponding one of a plurality of temperature detection tabs 1135 (described later) of the nip plate 1130 and adapted to transmit, to a controller (not illustrated), a temperature signal detected at each point of the nip plate 1130. The guide frame 1200 has guide portions 1230 that are in sliding contact with the inner surface 1110A of the fusing belt 1110 at upstream and downstream sides of the nip plate 1130, respectively.

The pressure roller 1150 nips the fusing belt 1110 in cooperation with the nip plate 1130 of the heating member 1101. As the pressure roller 1150 rotates, the fusing belt 1110 is driven to be circularly moved. The sheet S is thereby conveyed in the sheet conveying direction while nipped between the pressure roller 1150 and the fusing belt 1110.

Detailed Structure of Nip Plate

Next, the detailed structure of the nip plate 1130 will be described.

Figure 12A:
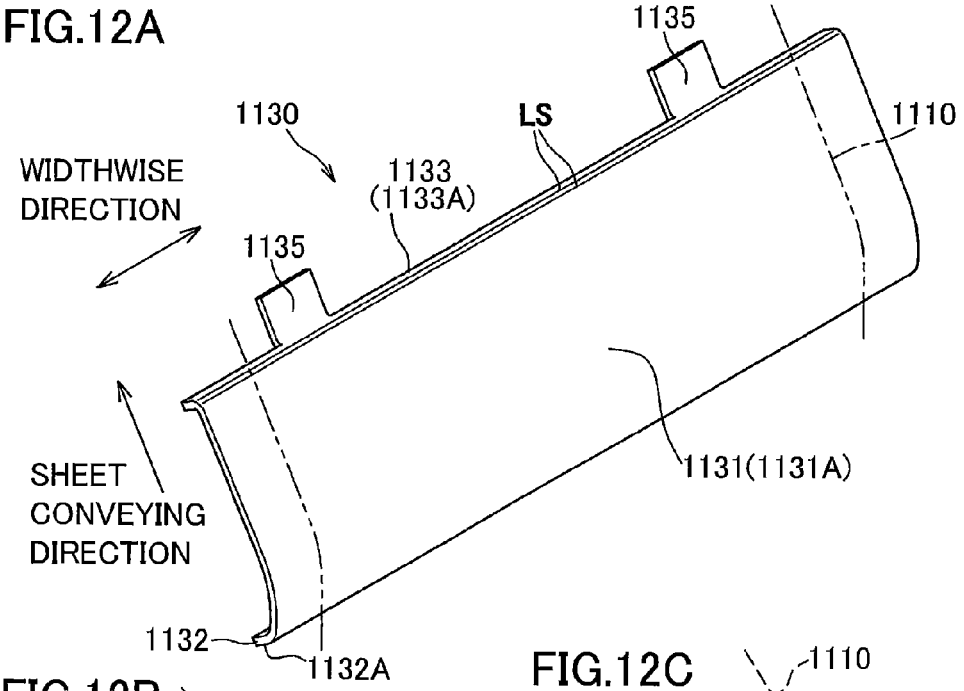
Figure 12B:
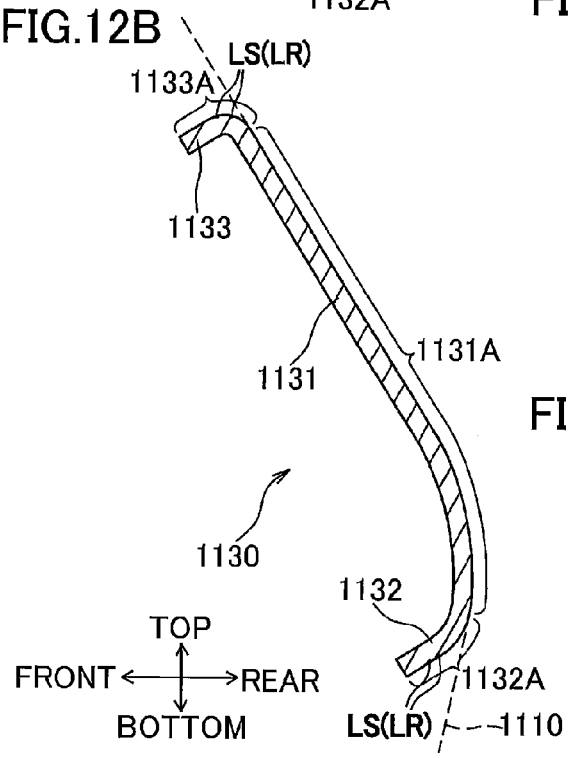
Figure 12C:
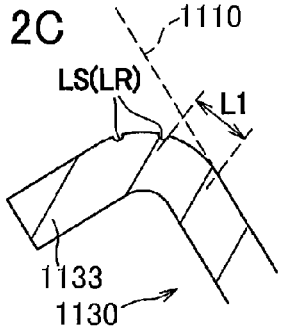
Figure 12D:
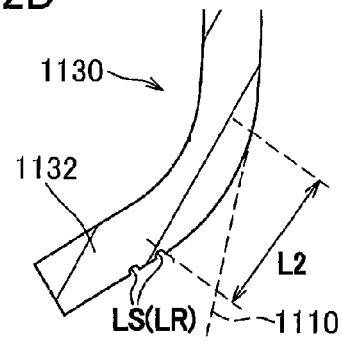

As illustrated in FIGS. 11 through 12D, the nip plate 1130 includes the base portion 1131, an upstream end portion 1132, a downstream end portion 1133, and the plurality of temperature detection tabs 1135 (two in the embodiment). The base portion 1131 is brought into sliding contact with the inner surface 1110A of the fusing belt 1110 as the fusing belt 1110 is driven to be circularly moved. The base portion 1131 has an upstream edge and a downstream edge in the sheet conveying direction. The upstream end portion 1132 extends from the upstream edge of the base portion 1131. The downstream end portion 1133 extends from the downstream edge of the base portion 1131. Each of the two temperature detection tabs 1135 is a rectangular protrusion formed along the downstream end portion 1133. Each of the temperature sensors 170 is disposed so as to face each of the temperature detection tabs 135 and detects a temperature at a point of the nip plate 1130. The detected temperature at each point of the nip plate 1130 is used for control of the fixing device 1100.

The base portion 1131 has a surface 1131A that faces the inner surface 1110A of the fusing belt 1110. The surface 1131A serves as "center region" that contacts the inner surface 1110A of the fusing belt 1110 through a lubricant such as fluorine-based grease when the fusing belt 1110 is circularly moved. Hereinafter, the surface 1131A will also be referred to as the center region 1131A.

The nip plate 1130 is bent at the upstream and downstream edges of the base portion 1131. As illustrated in FIG. 12B, the upstream end portion 1132 extends in a direction away from the inner surface 1110A of the fusing belt 1110 toward an upstream side in the sheet conveying direction from the upstream edge of the base portion 1131. The upstream end portion 1132 has a surface 1132A at a side facing the inner surface 1110A of the fusing belt 1110, and the surface 1132A is spaced apart from the inner surface 1110A of the circularly moving fusing belt 1110.

Similarly, the downstream end portion 1133 extends in a direction away from the inner surface 1110A of the fusing belt 1110 toward a downstream side in the sheet conveying direction from the downstream edge of the base portion 1131. The downstream end portion 1133 has a surface 1133A at the side facing the inner surface 1110A of the fusing belt 1110, and the surface 1133A is spaced apart from the inner surface 1110A of the circularly moving fusing belt 1110.

The surface 1132A of the upstream end portion 1132 serves as "upstream region", while the surface 1133A of the downstream end portion 1133 serves as "downstream region". At at least one of the surface 1132A (i.e. upstream region) and the surface 1133A (i.e. downstream region), a "retaining portion LR" is formed. The retaining portion LR has a retaining force (adhesive force) for retaining the lubricant greater than that of the center region 1131A. Hereinafter, the surface 1132A will also be referred to as the upstream region 1132A, and the surface 1133A will also be referred to as the downstream region 1133A.

As illustrated in FIGS. 12A through 12D, in the present embodiment, two lines LS are drawn by a scriber at each of the upstream region 1132A and the downstream region 1133A. These lines LS act to retain the lubricant therein, that is, to prevent outflow of the lubricant to the upstream side of the upstream region 1132A and to the downstream side of the downstream region 1133A. That is, a portion of each of the upstream region 1132A and the downstream region 1133A at which the scribe lines LS are formed constitutes the retaining portion LR. With this configuration, the lubricant overflowing from the upstream region 1132A and the downstream region 1133A can be prevented from leaking into an area in the fixing device 1100 where the lubricant should not enter. Further, a part of the lubricant retained at the regions 1132A and 1133A can be collected by the fusing belt 1110 during flapping of the fusing belt 1110.

As illustrated in FIG. 12C, at the downstream region 1133A, the scribe lines LS as the retaining portion LR are provided at a position spaced apart by an interval L1 from the center region 1131A. The center region 1131A is a contact portion that is in sliding contact with the inner surface 1110A of the fusing belt 1110. Further, as illustrated in FIG. 12D, at the upstream region 1132A, the scribe lines LS are provided at a position spaced apart by an interval L2 from the center region 1131A. The values of the intervals L1 and L2 are appropriately determined based on an estimated amount of the overflowing lubricant. Since the amount of the overflowing lubricant tends to be greater at the upstream region than the downstream region in the sheet conveying direction, the interval L2 is set greater than the interval L1 (L2>L1) in the present embodiment.

For example, the interval L1 may be set in a range of 0.0 mm to 0.5 mm, 0.5 mm to 1.0 mm, or 1.0 mm to 2.0 mm. Further, for example, the interval L2 may be set in a range of 0.0 mm to 1.0 mm, 1.0 mm to 2.0 mm, or 2.0 mm to 3.0 mm.

In the present embodiment, the fixing device 1100 is disposed in the main casing 1002 such that the center region 1131A is diagonally inclined frontward toward its downstream end (upper end) and faces upper-rearward. In other words, the center region 1131A has a diagonally upward posture. Accordingly, the downstream end portion 1133 (downstream region 1133A) is diagonally inclined downward toward its front end. That is, the downstream region 1133A is diagonally inclined downward. Thus, as compared to a configuration in which the center region 1131A faces downward, the lubricant is more likely to flow out from the downstream region 1133A by the action of gravity, so that it is concerned that the lubricant, if overflows, falls in the interior of the fixing device 1100. However, formation of the lines LS drawn by the scriber at the downstream region 1133A can prevent the lubricant from leaking into the area in the fixing device 1100 where the lubricant should not enter.

Incidentally, the scribe lines LS constituting the retaining portion LR in the present embodiment continuously extend in the widthwise direction (left-right direction) such that the retaining portion LR has a width in the widthwise direction equivalent to a width of the fusing belt 1110 in the widthwise direction. Further, edges of each of the scribe lines LS in the widthwise direction are positioned outside the edges of the fusing belt 1110 in the widthwise direction.

Since the scribe lines LS are formed so as to have a widthwise length equivalent to the width of the fusing belt 1110 in a direction perpendicular to the sheet conveying direction (i.e. "widthwise direction"), a lubricant outflow preventing effect can be demonstrated all over the retaining portion LR in the widthwise direction. That is, this configuration can effectively prevent outflow of the lubricant that flows out from the center region 1131A toward the downstream side thereof in the sheet conveying direction and scraped off at the upstream side thereof in the sheet conveying direction.

Figure 13:
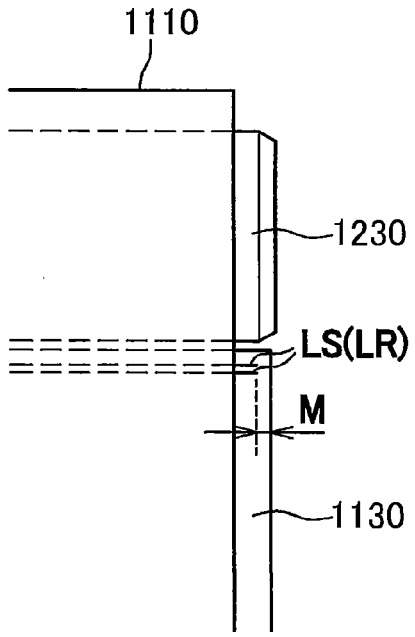
FIG. 13 is an enlarged top plan view of widthwise end portions of a fusing belt and the nip plate.

As illustrated in FIG. 13, in the present embodiment, the retaining portion LR is formed in the regions 1132A and 1133A with a predetermined margin M left from each edge of the nip plate 1130 in the widthwise direction. That is, the scribe lines LS are formed spaced apart from the widthwise edges (with the predetermined margin M left) of the nip plate 1130 and do not reach the edges of the nip plate 1130.

This is because the scribe lines LS extending in the widthwise direction act to prevent flowing of the lubricant in the sheet conveying direction and retain the lubricant therein and, at the same time, act to guide the lubricant overflowing to the both widthwise edges of the fusing belt 1110 to a side at which the fusing belt 1110 slides over the nip plate 1130 (i.e. to an inner side in the widthwise direction of the widthwise edges of the fusing belt 1110).

Further, the fusing belt 1110 slightly sways (slightly displaces) in the widthwise direction during its circular movement, however, the edges of the scribe lines LS (margin M) are set such that the width of the scribe lines LS in the widthwise direction fully covers the displacement area of the fusing belt 1110 in the widthwise direction. That is, the edges of the retaining portion LR in the widthwise direction are positioned outward of the widthwise edges of the fusing belt 1110 in the widthwise direction, so that the lubricant outflow preventing effect can be demonstrated effectively irrespective of whether or not the fusing belt 1110 is displaced in the widthwise direction. In other words, with this configuration, even when displacement in the widthwise direction occurs in the fusing belt 1110 while the fusing belt 1110 is driven to be circularly moved, outflow of the lubricant can reliably be prevented, as well as, outflow of the lubricant overflowing from the widthwise edges of the fusing belt 1110 can be effectively prevented.

Further, the scribe lines LS act to prevent outflow of the lubricant in the sheet conveying direction, as well as, act to uniformly disperse the lubricant in the widthwise direction of the fusing belt 1110. In the present embodiment, the scribe lines LS (retaining portion LR) do not reach the edges of the nip plate 1130 in the widthwise direction (in other words, the scribe lines LS are formed with the predetermined margin M left), so that it is also possible to prevent outflow of the lubricant from the edges of the nip plate 1130 in the widthwise direction.

As described above, in the fixing device 1100 according to the present embodiment, the nip plate 1130 as an example of a nip member has a surface facing the inner surface 1110A of the fusing belt 1110, and the surface includes the upstream region 1132A, the center region 1131A, and the downstream region 1133A arrayed in this order in the sheet conveying direction. The center region 1131A corresponds to an area of the surface of the nip plate 1130 contacting the fusing belt 1110 through the lubricant and is interposed between the upstream region 1132A and the downstream region 1133A in the sheet conveying direction. The upstream region 1132A extends from an upstream edge in the sheet conveying direction of the center region 1131A, whereas the downstream region 1133A extends from a downstream edge in the sheet conveying direction of the center region 1131A. At least one of the upstream region 1132A and the downstream region 1133A is formed with the retaining portion LR to provide the lubricant retaining force greater than that of the center region 1131A. Hence, contamination of the fixing device 1100 and reduction of the lubricant due to outflow of the lubricant can be prevented. Thus, degradation of fixing performance of the fixing device 1100 can be prevented. Further, the service life of the fixing device 1100 can be prolonged.

Further, the retaining portion LR is configured, by scribing, as a rough-surfaced portion having a surface roughness (for example, maximum height Rz) in the sheet conveying direction greater than that of the center region 1131A and can thus be realized by simple surface finishing. The maximum height Rz is a surface roughness parameter defined by the Japanese Industrial Standard (based on JIS B0601-2001). For example, the retaining portion LR has a maximum height Rz set in a range of 2.00 μm to 5.00 μm when the center region 1131A has a maximum height Rz set in a range of 0.10 μm to 2.00 μm. Alternatively, the maximum height Rz of the retaining portion LR may be set in a range of 5.00 μm to 10.0 μm when the maximum height Rz of the center region 1131A is set in a range of 2.00 μm to 5.00 μm. Further alternatively, the maximum height Rz of the retaining portion LR may be set in a range of 10.0 μm to 100 μm when the maximum height Rz of the center region 1131A is set in a range of 5.00 μm to 10.0 μm. That is, the retaining portion (rough-surfaced portion) is coarser than the center region 1131A.

In the present embodiment, the retaining portion LR is constituted by the two scribe lines LS. However, the present invention is not limited to this specific configuration. For example, the retaining portion LR may be formed by a single scribe line LS or three or more scribe lines LS. Further, by forming a ridge-like protrusion in place of the concave groove by scribing, the retaining portion LR having a maximum height Rz greater than that of the center region 1131A can be formed.

Further, even when the rough-surfaced portion is formed by filing (rasping) or surface-cutting (grooving) as illustrated in FIGS. 14A through 14D, the same operational advantages described for the fourth embodiment can be obtained. That is, outflow of the lubricant can be prevented by application of surface finishing (for example, application of filing in the widthwise direction) to a part of or the entire area of each of the upstream region 1132A and the downstream region 1133A such that, in the sheet conveying direction, the surface roughness thereof becomes greater than the remaining area.

Figure 14A:
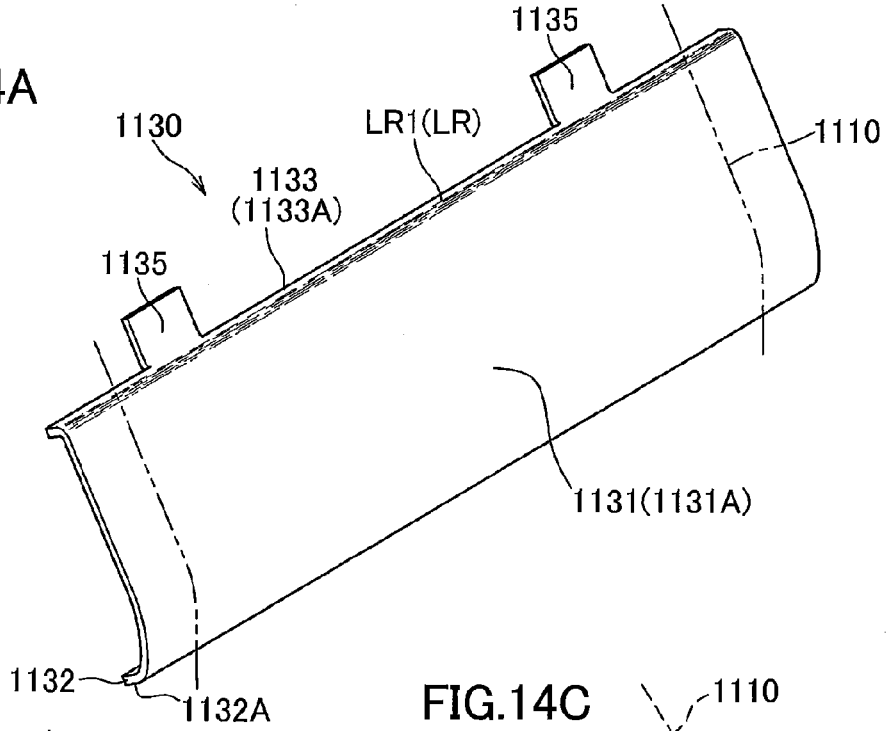
Figure 14B:
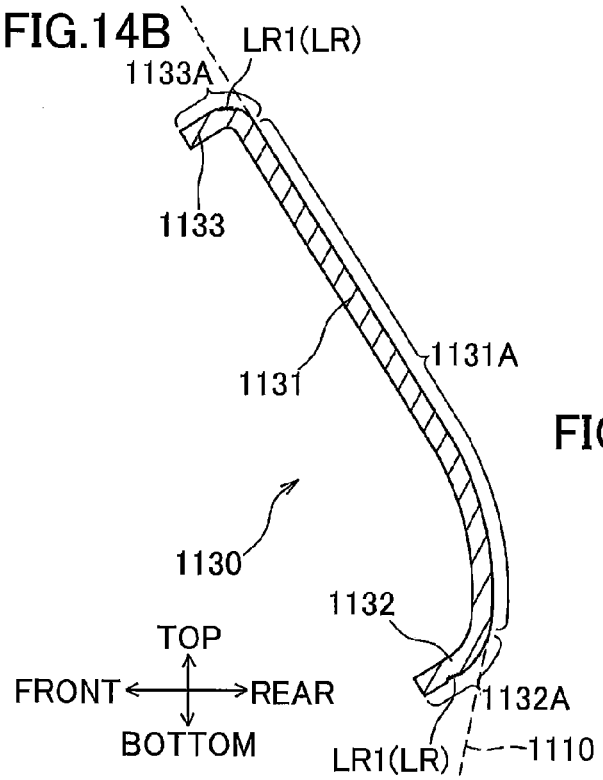
Figure 14C:
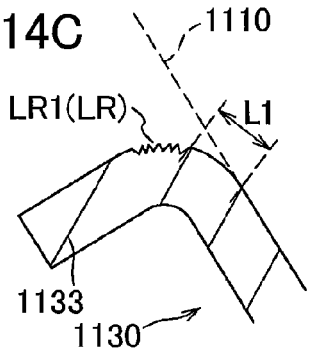
Figure 14D:
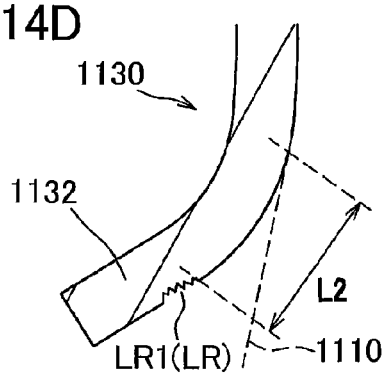

More specifically, as illustrated in FIG. 14D, a part of the upstream region 1132A adjacent to the upstream edge of the center region 1131A with which the fusing belt 1110 is in sliding contact is configured as the rough-surfaced portion having a surface roughness (for example, calculated average roughness Ra) in the sheet conveying direction substantially greater than that of the center region 1131A. Similarly, as illustrated in FIG. 14C, a part of the downstream region 1133A adjacent to the downstream edge of the center region 1131A with which the fusing belt 1110 is in sliding contact is configured as the rough-surfaced portion having a surface roughness (for example, calculated average roughness Ra) in the sheet conveying direction substantially greater than that of the center region 1131A. Hence, there can be provided a retaining portion LR1 in each of the upstream region 1132A and the downstream region 1133A, by which desired operational advantages can be achieved.

That is, the retaining portion LR1 is configured, by filing or surface-cutting, as the rough-surfaced portion having a surface roughness (for example, calculated average roughness Ra) in the sheet conveying direction greater than that of the center region 1131A. The calculated average roughness Ra is a surface roughness parameter defined by the Japanese Industrial Standard (JIS B0601-2001). For example, the retaining portion LR1 has a calculated average roughness Ra set in a range of 0.20 μm to 0.50 μm when the center region 1131A has a calculated average roughness Ra set in a range of 0.02 μm to 0.20 μm. Alternatively, the calculated average roughness Ra of the retaining portion LR1 may be set in a range of 0.50 μm to 1.00 μm when the calculated average roughness Ra of the center region 1131A is set in a range of 0.20 μm to 0.50 μm. Further alternatively, the calculated average roughness Ra of the retaining portion LR1 may be set in a range of 1.00 μm to 5.00 μm when the calculated average roughness Ra of the center region 1131A is set in a range of 0.50 μm to 1.00 μm.

As illustrated in FIG. 14C, at the downstream region 1133A, the retaining portion LR1 is provided at a position spaced apart by the interval L1 from the center region 1131A (i.e. contact portion in sliding contact with the inner surface 1110A of the fusing belt 1110). Further, as illustrated in FIG. 14D, at the upstream region 1132A, the retaining portion LR1 is provided at a position spaced apart by the interval L2 from the center region 1131A. The values of the intervals L1 and L2 are appropriately determined in the same manner as described in the fourth embodiment illustrated in FIGS. 12A to 12D.

By forming at least a part of the retaining portion LR1 in an area within 3 mm upstream from the upstream edge or downstream from the downstream edge of the center region 1131A in the sheet conveying direction, not only outflow of the lubricant from the contact portion can be prevented, but also the lubricant overflowing from the contact portion due to flapping of the fusing belt 1110 being driven to be circularly moved can be collected by the fusing belt 1110. That is, the lubricant retained in the retaining portion LR1 is brought into contact with the inner surface 1110A of the fusing belt 1110, and adhered thereto to be returned to the contact portion. Hence, outflow of the lubricant can be prevented more effectively.

As described above, the rough-surfaced portion constituting the retaining portion LR1 is formed in an area adjacent to (in immediate proximity to) the upstream or downstream edge of the center region 1131A, thereby allowing more effective collection of the lubricant overflowing from the contact portion. Further, for example, another rough-surfaced portion can be formed continuously (or discontinuously) outside (on the outer upstream-downstream side of) the above rough-surfaced portion. Such a rough-surfaced portion also has a lubricant retaining force for retaining the lubricant greater than that of the contact portion and can thus prevent outflow of the lubricant. This prevents adhesion of the lubricant to components inside the fixing device 1100 and other members of the laser printer 1001, thereby preventing contamination thereof.

A formation method of the retaining portion LR is not limited to surface-roughening processing such as scribing, filing (rasping), or surface-cutting (grooving). Conventionally, for improvement in slidability (smoothness), a surface of a nip plate that faces an inner surface of a fusing belt is coated with an electroless nickel plating layer, a metal oxide film, or a fluorine resin layer. By not applying such coating-layer to only a desired area of the surface of the nip plate 1130 facing the inner surface 1110A of the fusing belt 1110 (e.g., a part of the upstream region 132A or a part of the downstream region 1133A as described above), the area can be configured as the retaining portion LR having the lubricant outflow prevention effect.

Figure 15A:
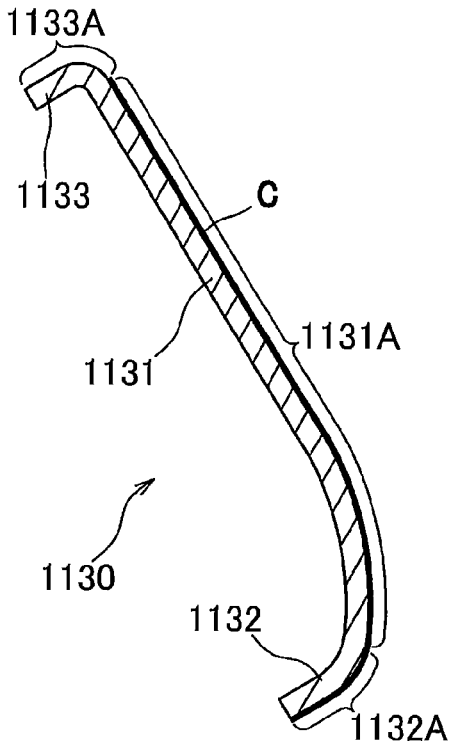
FIGS. 15A and 15B are cross-sectional views of a nip plate according to another variation of the fourth embodiment.

FIG. 15A illustrates an example of the retaining portion LR formed by selective application of the conventional coating-layer formation processing. On the surface of the nip plate 1130 facing the inner surface 1110A of the fusing belt 1110, a coating layer C is formed over the center region 1131A, whereas the coating layer C is not formed in a part of the surface that does not contact the inner surface 1110A of the fusing belt 1110. That is, in FIG. 15A, the coating layer C is not formed in the downstream region 1133A.

Alternatively, the retaining portion LR as illustrated in FIG. 15A may be formed by applying the conventional coating-layer formation processing to the entire surface of the nip plate 1130 facing the inner surface 1110A of the fusing belt 1110 and then removing (etching) the coating layer C in a desired area. Hence, processing of the retaining portion LR can easily be achieved by selectively applying, to a desired portion, coating-layer formation processing that is normally performed in formation of the nip plate 1130, or by forming a coating layer on the entire surface of the nip plate 1130 that faces the inner surface 1110A of the fusing belt 1110 and then removing the coating layer in a desired area.

In addition to the method that increases the surface roughness of the surface of the nip plate 1130 facing the inner surface 1110A of the fusing belt 1110 only in a desired area, there can be employed a method that changes characteristics (surface shape that can be expressed by the roughness, or wettability with respect to the lubricant, etc.) of the surface by changing a type of the coating layer C to increase the lubricant retaining force only in a desired area to thereby form the retaining portion LR. In an example illustrated in FIG. 15B, a coating layer C1 is formed throughout the center region 1131A on the surface of the nip plate 1130 facing the inner surface 1110A of the fusing belt 1110, and a coating layer C2 having a lubricant retaining force greater than that of the coating layer C1 is formed on the entire downstream region 1133A that does not contact the inner surface 1110A of the fusing belt 1110. For example, when plating including polytetrafluoroethylene (PTFE) is applied to the surface of the nip plate 1130 facing the inner surface 1110A of the fusing belt 1110, the lubricant retaining force of the coating layer C2 can be increased by making a blend ratio of PTFE lower in the coating layer C2 than in the coating layer C1.

Hence, the rough-surfaced portion constituting the retaining portion LR is provided by processing a portion of the surface of the nip plate 1130 facing the inner surface 1110A o the fusing belt 1110 to become at least one of the upstream region 1132A and the downstream region 1133A. The processing is selected from at least one of scribing, rasping, surface-cutting, grooving, coating, and removal of coating (e.g. etching). Further, the portion subjected to the processing is dispersed in the retaining portion LR such that any imaginary plane passing the retaining portion LR and extending parallel to the sheet conveying direction intersects the portion subjected to the processing.

6. Modifications of Fourth Embodiment

While the present invention has been described in detail with reference to the fourth embodiment thereof, it would be apparent to those skilled in the art that various changes and modifications may be made therein without departing from the spirit of the present invention. In the following description, only parts differing from those of the fourth embodiment will be described in detail.

Figure 15B:
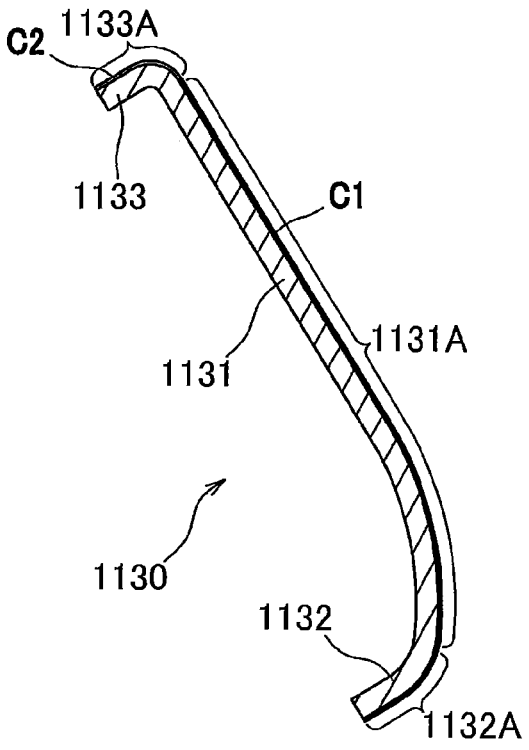
Figure 15B:
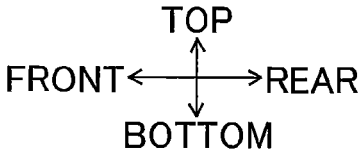

In the fourth embodiment described with reference to FIGS. 10 through 14D, the retaining portion LR is formed at both the upstream region 1132A and the downstream region 1133A. Alternatively, however, as illustrated in FIGS. 15A and 15B, the retaining portion LR of the present invention may be formed at only one of the upstream region 1132A and the downstream region 1133A. Further, the retaining portion LR may be formed in the entire area of the upstream region 1132A and/or the downstream region 1133A. Alternatively, the retaining portion LR may be formed in a part of the upstream region 1132A and/or the downstream region 1133A.

Although the nip plate 1130 is used as a nip member in the fourth embodiment, the present invention is not limited to this. For example, a block-shaped or pad-shaped nip member may be used in place of the plate-like nip member.

Further, in the fourth embodiment, the surfaces (at the side facing the inner surface 1110A of the fusing belt 1110) of the center region 1131A (contact portion) of the nip plate 1130, the upstream region 1132A thereof, and the downstream region 1133A thereof are defined respectively as the surfaces of the base portion 1131, the upstream end portion 1132, and the downstream end portion 1133 which are obtained by bending the plate-like nip plate 1130 at the upstream and downstream edges of the base portion 1131. However, the present invention is not limited to this.

In a case where the nip member is a block-shaped member, the block-shaped nip member has a configuration in which the surface 1132A spaced apart from the inner surface 1110A of the moving fusing belt 1110 and the surface 1133A spaced apart from the inner surface 1110A of the moving fusing belt 1110 both extend from the contact portion (center region 1131A). The surfaces 1132A and 1133A can be defined as the respective upstream and downstream regions each constituting the retaining portion LR.

In the fourth embodiment, the halogen lamp 1120 employed as a heat source (heater) of the fixing device 1100 heats the fusing belt 1110 through the nip plate 1130 with radiant heat therefrom to thereby heat the toner on the sheet S. However, the heat source of the fixing device 1100 is not limited to this configuration. For example, the heat source may be a heating element such as a carbon heater or a ceramic heater, or a heat source, such as an IH heater, that does not generate heat by itself but makes a metallic belt or a metallic nip plate generate heat by an electromagnetic induction heating method. That is, the type or arrangement of the heat source may be arbitrarily selected as long as the fusing belt 1110 can be directly or indirectly heated.

Figure 16A:
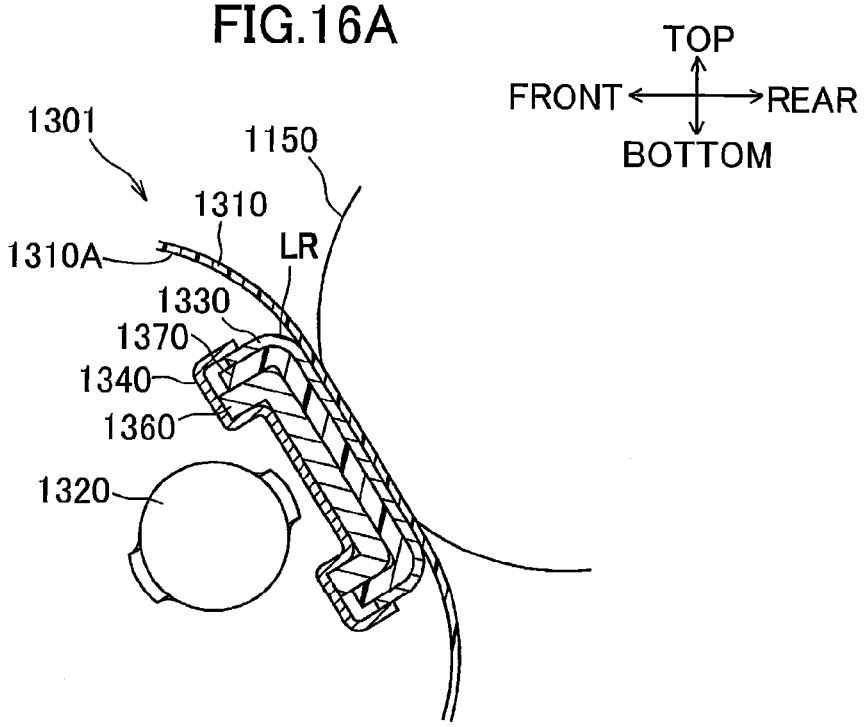
FIG. 16A is a cross-sectional view of a heating member of a fixing device according to one modification of the fourth embodiment.

The structure of the heating member 1101 of the fixing device 1100 can be variously modified. For example, a heating member 1301 having a structure illustrated in FIG. 16A may be adopted. In the heating member 301, a heat-insulating resin member 1370 is provided between a halogen lamp 1320 and a nip plate 1330 so as to provide radiant heat from the halogen lamp 1320 for a fusing belt 1310 directly or through a reflection plate 1340 (without intervention of the nip plate 1330). The heating member 1301 includes a stay 1360 that supports the nip plate 1330 and the reflection plate 1340.

Figure 16B:
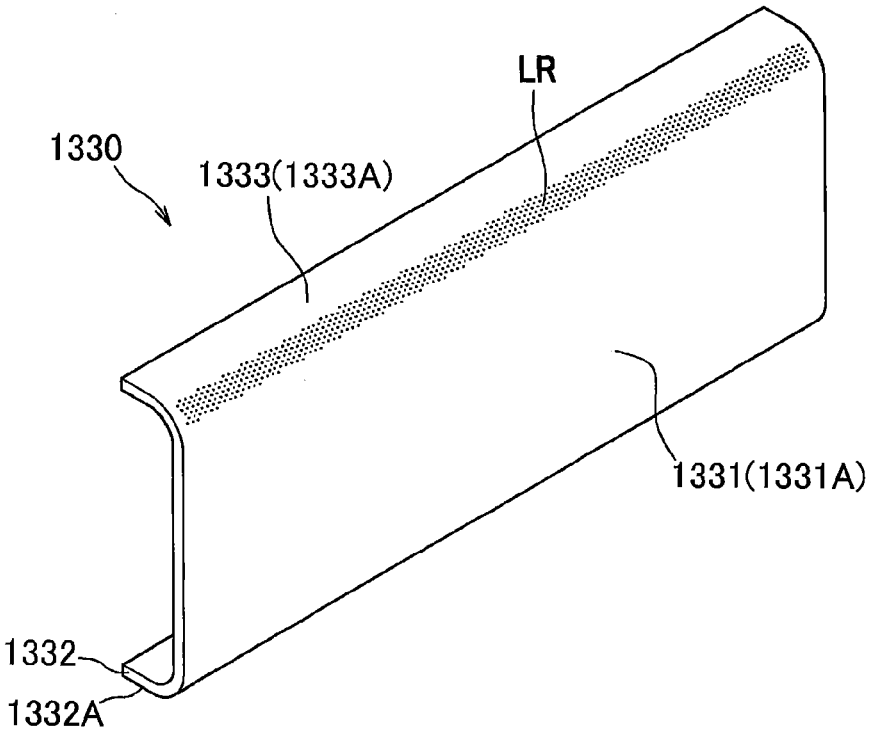
FIG. 16B is a perspective view of a nip plate in the fixing device according to the modification.

As illustrated in FIG. 16B, the nip plate 1330 includes a base portion 1331 having a center region 1331A, an upstream end portion 1332 having an upstream region 1332A, and a downstream end portion 1333 having a downstream region 1333A. The upstream region 1332A and the downstream region 1333A do not contact an inner surface 1310A of the fusing belt 1310 while the fusing belt 1310 is driven to be circularly moved. As in the nip plate 1330, the retaining portion LR (part having a lubricant retaining force greater than that of the center region 1331A) can be formed at at least one of the upstream region 1332A and the downstream region 1333A, by application of one of or a plurality of methods selected from the processings such as scribing, filing (rasping), surface-cutting, grooving, coating, removal of coating, and etching described above. By adopting one of or the plurality of the above methods, the retaining portion LR can be easily realized in a simple manner and at low cost. Incidentally, in the example illustrated in FIG. 16B, the retaining portion LR is formed only at the downstream region 1333A.

In the fourth embodiment, the photosensitive drum 1041 is employed as an image carrier, but not limited thereto. For example, the image carrier may be an intermediate transfer drum or an intermediate transfer belt configured to be capable of carrying a toner image that has been transferred thereonto from the photosensitive drum.

In the fourth embodiment, the fixing device 1100 is disposed in the laser printer 1001 such that the surface of the nip plate 1130 that is in sliding contact with the inner surface 1110A of the fusing belt 1110 (i.e. center region 1131A) has an upward or diagonally upward posture. However, the present invention is not limited to this. As long as the surface of nip member at the side facing the inner surface of the fusing belt has, in the sheet conveying direction, the center region 1131A corresponding to the area that contacts the fusing belt through the lubricant and the upstream and downstream regions 1132A, 1133A extending respectively from the upstream and downstream edges of the center region 1131A, outflow of the lubricant from the upstream or downstream region 1132A, 1133A can be prevented according to the present invention. Thus, the present invention can also be suitably applied to a fixing device in which a nip member is disposed such that its center region has a downward or diagonally downward posture.

In the fourth embodiment, the sheet S, including a cardboard, a postcard, a thin paper, etc., is employed as a recording sheet. However, the present invention is not limited to this. For example, an OHP sheet may be available as the recording sheet.

In the fourth embodiment, the laser printer 1001 is employed as an image forming apparatus. However, the present invention is not limited to this. For example, the image forming apparatus may be a copying machine or a multifunction machine provided with a document reader such as a flat-bed scanner.

What is claimed is:

1. A fixing device comprising:

an endless fusing belt having an inner surface and an outer surface and defining an internal space;

a nip member extending through the internal space and having a surface facing the inner surface; and a backup member configured to nip the fusing belt in cooperation with the nip member to provide a nip region between the backup member and the fusing belt, the backup member being configured to convey a recording sheet in a sheet conveying direction with the recording sheet nipped between the backup member and the fusing belt, the surface of the nip member including an upstream region, a center region, and a downstream region arrayed in this order in the sheet conveying direction, the center region being configured to contact the fusing belt through a lubricant, the upstream region and the downstream region being spaced apart from the fusing belt, the surface of the nip member having the center region and a remaining region other than the center region, the remaining region including the upstream region and the downstream region, the remaining region in its entirety being out of contact with the fusing belt, at least one of the upstream region and the downstream region having a retaining portion configured to provide a lubricant retaining force greater than that of the center region, the retaining portion being provided at a position spaced apart from the nip region and out of contact with the fusing belt, the retaining portion being provided at a position spaced apart by an interval from the center region.

2. The fixing device as claimed in claim 1, wherein the retaining portion comprises a rough-surfaced portion having a surface roughness in the sheet conveying direction greater than that of the center region.

3. The fixing device as claimed in claim 1, wherein the nip member comprises a base layer and a coating layer formed over the base layer such that, when the upstream region has the retaining portion, the coating layer is provided at the center region and the upstream region is free from the coating layer, the retaining portion being provided in the upstream region at a position free from the coating layer.

4. The fixing device as claimed in claim 1, wherein the nip member comprises a base layer and a coating layer formed over the base layer such that, when the downstream region has the retaining portion, the coating layer is provided at the center region and the downstream region is free from the coating layer, the retaining portion being provided in the downstream region at a position free from the coating layer.

5. The fixing device as claimed in claim 1, wherein the fusing belt has widthwise edges in a widthwise direction perpendicular to the sheet conveying direction, and wherein the retaining portion has edges in the widthwise direction, each of the edges of the retaining portion being positioned outward of each of the widthwise edges of the fusing belt in the widthwise direction.

6. The fixing device as claimed in claim 5, wherein the nip member has edges in the widthwise direction, and wherein the edges of the retaining portion are respectively spaced apart from the edges of the nip member in the widthwise direction to provide a predetermined margin in the widthwise direction.

7. The fixing device as claimed in claim 1, wherein the center region has an upstream edge in the sheet conveying direction, and wherein, when the upstream region has the retaining portion, the retaining portion has a portion positioned within 3 mm upstream of the upstream edge of the center region in the sheet conveying direction.

8. The fixing device as claimed in claim 1, wherein the center region has a downstream edge in the sheet conveying direction, and wherein, when the downstream region has the retaining portion, the retaining portion has a portion positioned within 3 mm downstream of the downstream edge in the sheet conveying direction.

9. The fixing device as claimed in claim 1, wherein the nip member comprises a base layer, a first coating layer formed over the base layer, and a second coating layer formed over the base layer, the first coating layer being provided at the center region, the second coating layer being provided at at least one of the upstream region and the downstream region, the second coating layer having a lubricant retaining force greater than that of the first coating layer to provide the retaining portion.

10. The fixing device as claimed in claim 1, wherein the retaining portion comprises a first retaining portion provided in the upstream region and a second retaining portion provided in the downstream region, the first retaining portion being provided at a position spaced apart by a first interval from the center region, the second retaining portion being provided at a position spaced apart by a second interval from the center region, the first interval being greater than the second interval.

11. A fixing device comprising:

an endless fusing belt having an inner surface and an outer surface and defining an internal space;

a nip member extending through the internal space and having a surface facing the inner surface; and a backup member configured to nip the fusing belt in cooperation with the nip member and to convey a recording sheet in a sheet conveying direction with the recording sheet nipped between the backup member and the fusing belt, the surface of the nip member including an upstream region, a center region, and a downstream region arrayed in this order in the sheet conveying direction, the center region being configured to contact the fusing belt through a lubricant, the upstream region and the downstream region being spaced apart from the fusing belt, at least one of the upstream region and the downstream region having a retaining portion configured to provide a lubricant retaining force greater than that of the center region, wherein the fusing belt has a widthwise edges in a widthwise direction perpendicular to the sheet conveying direction, and wherein the retaining portion has edges in the widthwise direction aligned with the widthwise edges of the fusing belt in the widthwise direction.

12. A fixing device comprising:

an endless fusing belt having an inner surface and an outer surface and defining an internal space;

a nip member extending through the internal space and having a surface facing the inner surface; and a backup member configured to nip the fusing belt in cooperation with the nip member to provide a nip region between the backup member and the fusing belt, the backup member being configured to convey a recording sheet in a sheet conveying direction with the recording sheet nipped between the backup member and the fusing belt, the surface of the nip member including an upstream region, a center region, and a downstream region arrayed in this order in the sheet conveying direction, the center region being configured to contact the fusing belt through a lubricant, the upstream region and the downstream region being spaced apart from the fusing belt, at least one of the upstream region and the downstream region having a retaining portion configured to provide a lubricant retaining force greater than that of the center region, the retaining portion being provided at a position spaced apart from the nip region and out of contact with the fusing belt, wherein the nip member comprises a base layer and a coating layer formed over the base layer such that, when the upstream region has the retaining portion, the coating layer is provided at the center region and the upstream region is free from the coating layer, the retaining portion being provided in the upstream region at a position free from the coating layer.

13. A fixing device comprising:

an endless fusing belt having an inner surface and an outer surface and defining an internal space;

a nip member extending through the internal space and having a surface facing the inner surface; and a backup member configured to nip the fusing belt in cooperation with the nip member to provide a nip region between the backup member and the fusing belt, the backup member being configured to convey a recording sheet in a sheet conveying direction with the recording sheet nipped between the backup member and the fusing belt, the surface of the nip member including an upstream region, a center region, and a downstream region arrayed in this order in the sheet conveying direction, the center region being configured to contact the fusing belt through a lubricant, the upstream region and the downstream region being spaced apart from the fusing belt, at least one of the upstream region and the downstream region having a retaining portion configured to provide a lubricant retaining force greater than that of the center region, the retaining portion being provided at a position spaced apart from the nip region and out of contact with the fusing belt, wherein the nip member comprises a base layer and a coating layer formed over the base layer such that, when the downstream region has the retaining portion, the coating layer is provided at the center region and the downstream region is free from the coating layer, the retaining portion being provided in the downstream region at a position free from the coating layer.

14. A fixing device comprising:

an endless fusing belt having an inner surface and an outer surface and defining an internal space;

a nip member extending through the internal space and having a surface facing the inner surface; and a backup member configured to nip the fusing belt in cooperation with the nip member to provide a nip region between the backup member and the fusing belt, the backup member being configured to convey a recording sheet in a sheet conveying direction with the recording sheet nipped between the backup member and the fusing belt, the surface of the nip member including an upstream region, a center region, and a downstream region arrayed in this order in the sheet conveying direction, the center region being configured to contact the fusing belt through a lubricant, the upstream region and the downstream region being spaced apart from the fusing belt, at least one of the upstream region and the downstream region having a retaining portion configured to provide a lubricant retaining force greater than that of the center region, the retaining portion being provided at a position spaced apart from the nip region and out of contact with the fusing belt, wherein the fusing belt has widthwise edges in a widthwise direction perpendicular to the sheet conveying direction, wherein the retaining portion has edges in the widthwise direction, each of the edges of the retaining portion being positioned outward of each of the widthwise edges of the fusing belt in the widthwise direction, wherein the nip member has edges in the widthwise direction, and wherein the edges of the retaining portion are respectively spaced apart from the edges of the nip member in the widthwise direction to provide a predetermined margin in the widthwise direction.

* * * * *